US005310645A

United States Patent [19]

Ikegawa et al.

[11] Patent Number: 5,310,645

[45] Date of Patent: May 10, 1994

[54] SILVER HALIDE PHOTOGRAPHIC MATERIAL

[75] Inventors: Akihiko Ikegawa; Masayuki Kuramitsu; Masaki Okazaki, all of Kanagawa, Japan

[73] Assignee: Fuji Photo Film Co., Ltd., Kanagawa, Japan

[21] Appl. No.: 957,042

[22] Filed: Oct. 6, 1992

[30] Foreign Application Priority Data

Oct. 7, 1991 [JP] Japan ..... 3-285532
Jan. 14, 1992 [JP] Japan ..... 4-23343

[51] Int. Cl.[5] ..... G03C 1/18; G03C 1/29

[52] U.S. Cl. ..... 430/574; 430/588

[58] Field of Search ..... 430/574, 588, 567

[56] References Cited

U.S. PATENT DOCUMENTS 3,282,933 11/1966 Nys et al. ..... 430/588
3,615,634 4/1968 Götze et al. ..... 430/588
4,028,115 6/1977 Hinata et al. ..... 430/574

FOREIGN PATENT DOCUMENTS 1223289 6/1960 France .

*Primary Examiner*—Janet C. Baxter
*Attorney, Agent, or Firm*—Sughrue, Mion, Zinn, Macpeak & Seas

[57] ABSTRACT

Disclosed is a novel silver halide photographic material is provided comprising a support having thereon (a) a layer containing at least one methine compound represented by the following general formula (I) and (b) a layer containing at least one methine compound represented by the following general formula (II), (III), (IV) or (V):

(I)

(II)

(III)

(IV)

(V)

wherein the variables in the formulas are defined in the detailed description. In a preferred embodiment, the silver halide photographic material comprises at least one methine compound represented by general formula (I) and at least one methine compound represented by general formula (II) or (V) in the same layer.

9 Claims, No Drawings

SILVER HALIDE PHOTOGRAPHIC MATERIAL

FIELD OF THE INVENTION

The present invention relates to a silver halide photographic material which provides improvements in both sensitivity and the inhibition of color remaining during development.

BACKGROUND OF THE INVENTION

In recent years, increases in the speed of development processing and the tendency to add a large amount of sensitizing dyes have worsened the problems that some sensitizing dyes contained in silver halide photographic materials are left uneluted during development and that colors remain in the photographic material (so-called color remaining).

Heretofore, there have been proposed as sensitizing dyes causing little color remaining those dyes containing hydrophilic substituents such as sulfamoyl group and carbamoyl group (as disclosed in JP-A-1-147451, JP-A-61-294429, and JP-A-61-77843 (the term "JP-A" as used herein means an "unexamined published Japanese patent application"), and JP-B-45-32749 (the term "JP-B" as used herein means an "examined Japanese patent publication")). However, since the adsorption of sensitizing dyes normally falls with the increasing hydrophilicity, all these proposals leave much to be desired in sensitivity as well as in color remaining. Further, the sensitizing dyes disclosed in U.S. Pat. No. 3,282,933 and European Patent 451816A1 have an appreciable effect eliminating color remaining but leave much to be desired in the provision of sufficient sensitivity.

SUMMARY OF THE INVENTION

It is therefore an object of the present invention to provide a silver halide photographic material which provides improvements in both sensitivity and the inhibition of color remaining during development.

This and other objects of the present invention are accomplished with a silver halide photographic material comprising a support having thereon (a) a layer containing at least one methine compound represented by the following general formula (I) and (b) a layer containing at least one methine compound represented by the following general formula (II), (III), (IV) or (V):

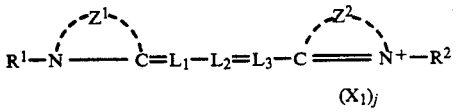

(I)

wherein $R^1$ represents $-(CH_2)_r-CONHSO_2-R^3$, $-(CH_2)_s-SO_2NHCO-R^4$, $-(CH_2)_t-CONHCO-R^5$ or $-(CH_2)_u-SO_2NHSO_2-R^6$ in which $R^3$, $R^4$, $R^5$ and $R^6$ each represents an alkyl, alkoxy or amino group, r, s, t and u each represents an integer 1 to 5, and $R^2$ has the same meaning as $R^1$ or represents an alkyl group other than those represented by $R^1$; $Z^1$ and $Z^2$ each represents a nonmetallic atom group required to form a benzothiazole nucleus or a benzoselenazole nucleus; $L_1$, $L_2$ and $L_3$ each represents a methine group; $X_1$ represents an anion; and j represents an integer required to adjust the charge in the molecule to 0;

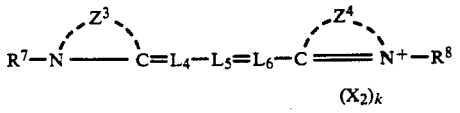

(II)

wherein $R^7$ and $R^8$ each represents an alkyl group other than those represented by $R^1$; $Z^3$ and $Z^4$ each has the same meaning as $Z^1$; $L_4$, $L_5$ and $L_6$ each has the same meaning as $L_1$; $X_2$ has the same meaning as $X_1$; and k has the same meaning as j;

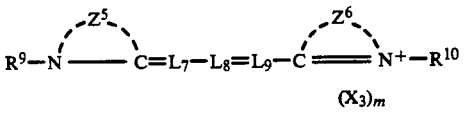

(III)

wherein $R^9$ and $R^{10}$ each has the same meaning as $R^2$; $Z^5$ and $Z^6$ each has the same meaning as $Z^1$, with the proviso that at least one of $Z^5$ and $Z^6$ is substituted by a carboxyl group; $L_7$, $L_8$ and $L_9$ each has the same meaning as $L_1$; $X_3$ has the same meaning as $X_1$; and m has the same meaning as j;

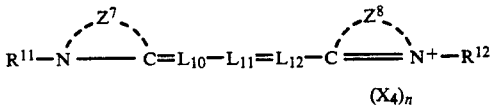

(IV)

wherein $R^{11}$ and $R^{12}$ each has the same meaning as $R^2$; $Z^7$ represents a nonmetallic atom group required to form a benzoxazole nucleus or a benzoimidazole nucleus; $Z^8$ has the same meaning as $Z^1$; $L_{10}$, $L_{11}$ and $L_{12}$ each has the same meaning as $L_1$; $X_4$ has the same meaning as $X_1$; and n has the same meaning as j;

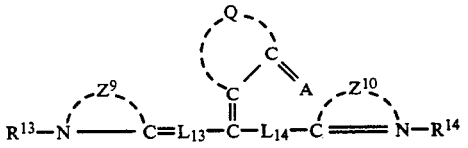

(V)

wherein $R^{13}$ and $R^{14}$ each has the same meaning as $R^2$; $Z^9$ and $Z^{10}$ each has the same meaning as $Z^1$; $L_{13}$ and $L_{14}$ each has the same meaning as $L_1$; Q represents a nonmetallic atom group required to form a 5-membered or 6-membered carbon or heterocyclic group; and A represents an oxygen or sulfur atom. The layers (a) and (b) may be the same or different.

DETAILED DESCRIPTION OF THE INVENTION

The present invention is described in detail below.

The alkyl group represented by $R^3$, $R^4$, $R^5$ or $R^6$ may be substituted and preferably contains 4 or less carbon atoms. Particularly preferred as such alkyl groups are methyl, ethyl, hydroxyethyl and aminoethyl groups. The alkoxy group represented by $R^3$, $R^4$, $R^5$ or $R^6$ may be substituted and preferably contains 4 or less carbon atoms. Particularly preferred as such alkoxy groups are methoxy, ethoxy, methoxyethoxy and hydroxyethoxy groups. The amino group represented by $R^3$, $R^4$, $R^5$ or $R^6$ may be substituted by an alkyl group, a hydroxyalkyl group, an alkoxyalkyl group or the like which may together form a ring and preferably contains 8 or less carbon atoms. Particularly preferred as such amino groups are methylamino, dimethylamino, ethylamino, diethylamino, hydroxyethylamino, morpholino and pyrrolidino groups.

The hydrogen atom bonded to the nitrogen atom adjacent to the carbonyl group or sulfonyl group in $R^1$ is dissociative. Accordingly, $R^1$ may take the form of $-(CH_2)_r-CON^-SO_2-R^3$, $-(CH_2)_s-SO_2N^--CO-R^4$, $-(CH_2)_t-CON^-CO-R^5$ or $-(CH_2)_u-SO_2N^-SO_2-R^6$ in the presence of a base or the like.

The alkyl group represented by $R^2$ other than those represented by $R^1$ and the alkyl group represented by $R^7$ and $R^8$ may be substituted and preferably contains 5 or less carbon atoms. Particularly preferred among such alkyl groups are 2-sulfoethyl, 3-sulfopropyl, 4-sulfobutyl and 3-sulfobutyl groups. The suffixes r, s, t and u each preferably is an integer 1 to 3.

The benzothiazole nucleus formed by $Z^1$ or $Z^2$ and N-C may be substituted. Examples of such benzothiazole nuclei include benzothiazoles (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenthylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydroxybenzothiazole, 4-phenylbenzothiazole) and naphthothiazoles (e.g., naphtho[2,1-d]thiazole, naphtho[1,2-d]thiazole, naphtho[2,3-d]-thiazole, 5-methoxynaphtho[1,2-d]thiazole, 7-ethoxynaphtho[2,1d]thiazole, 8-methoxynaphtho[2,1-d]thiazole, 5-methoxynaphtho[2,3-d]thiazole). The benzoselenazole nucleus formed by $Z^1$ or $Z^2$ and N-C may be substituted. Examples of such benzoselenazole nuclei include benzoselenazoles (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole) and naphthoselenazoles (e.g., naphtho[2,1-d]selenazole, naphtho[1,2-d]selenazole).

The benzoxazole nucleus or benzoimidazole nucleus formed by $Z^7$ and N-C may be substituted. Examples of such benzoxazole nuclei include benzoxazoles (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole) and naphthoxazoles (e.g., naphtho[2,1-d]oxazole, naphtho[1,2-d]oxazole, naphtho[2,3-d]oxazole, 5-nitronaphtho[2,1-d]oxazole). Examples of such benzoimidazole nuclei include 1-alkylbenzoimidazoles, 1-alkyl-5-chlorobenzoimidazoles, 1-alkyl-5,6-dichlorobenzoimidazoles, 1-alkyl-5-methoxybenzoimidazoles, 1-alkyl-5-cyanobenzoimidazoles, 1-alkyl-5-fluorobenzoimidazoles, 1-alkyl-5-trifluoromethylbenzoimidazoles, 1-alkyl-6-chloro-5-cyanobenzoimidazoles, 1-alkyl-6-chloro-5-trifluoromethylbenzoimidazoles, 1-allyl-5,6-dichlorobenzoimidazole, 1-allyl-5-chlorobenzoimidazole, 1-arylbenzoimidazoles, 1-aryl-5-chlorobenzoimidazoles, 1-aryl-5,6-dichlorobenzoimidazoles, 1-aryl-5-methoxybenzoimidazoles, 1-aryl-5-cyanobenzoimidazoles, naphthoimidazoles (e.g., 1-alkylnaphtho[1,2-d]imidazoles, 1-arylnaphtho[1,2-d]imidazoles). The above mentioned alkyl group is preferably a $C_{1-8}$ alkyl group such as an unsubstituted alkyl group (e.g., methyl, ethyl, propyl, isopropyl, butyl) and a hydroxyalkyl group (e.g., 2-hydroxyethyl, 3-hydroxypropyl). Particularly preferred among these alkyl groups are methyl and ethyl groups. The above mentioned aryl group represents phenyl, halogen (e.g., chloro)-substituted phenyl, alkyl (e.g., methyl)-substituted phenyl or alkoxy (e.g., methoxy)-substituted phenyl.

Examples of the 5-membered or 6-membered carbon ring or heterocyclic group formed by Q and C—C=A include rhodanine nucleus, 2-thiohydantoin nucleus, 2-thioxoxazolidin-4-one nucleus, 2-pyrazolin-5-one nucleus, barbituric acid nucleus, 2-thiobaribituric acid nucleus, thiazolin-2,5-dione nucleus, thiazolidin-4-one nucleus, isoxazolone nucleus, hydantoin nucleus, and indanedione nucleus.

The methine group represented by $L^1$, $L^2$ or $L^3$ may be substituted by substituents such as an alkyl group which may be substituted (e.g., methyl, ethyl, 2-carboxylethyl), an aryl group which may be substituted (e.g., phenyl, o-carboxyphenyl), a halogen atom (e.g., chlorine, bromine), an alkoxy group (e.g., methoxy, ethoxy) and an alkylthio group (e.g., methylthio, ethylthio). These substituents may form a ring together with other methine groups or auxochromes. Examples of the anion represented by $X_1$ include inorganic or organic acid anions (e.g., chloride, bromide, iodide, p-toluenesulfonate, napthalenedisulfonate, methanesulfonate, methyl sulfate, ethyl sulfate, perchlorate).

The synthesis of the compounds of the present invention represented by general formulae (I) to (V) can be accomplished by methods disclosed in F. M. Hamer, *Heterocyclic Compounds-Cyanine Dyes and Related Compounds*, John Wiley & Sons (New York, London, 1964); D. M. Sturmer, *Heterocyclic Compounds-Special Topics in Heterocyclic Chemistry*, Chapter 18, Paragraph 14, pp. 482–515, John Wiley & Sons (New York, London, 1977); and *Rodd's Chemistry of Carbon Compounds*, 2nd Ed., vol. IV, part B (1977), Chapter 15, pp. 369–422, 2nd Ed., vol. IV, part B (1985), Chapter 15, pp. 267–296, Elsevier Science Publishing Company Inc. (New York).

Specific examples of the methine compounds represented by general formulae (I), (II), (III), (IV) or (V) are shown below, but the present invention should not be construed as being limited thereto:

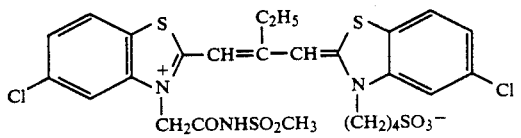

I-1

-continued
I-2
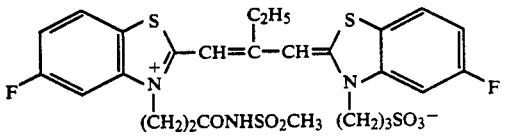
I-3
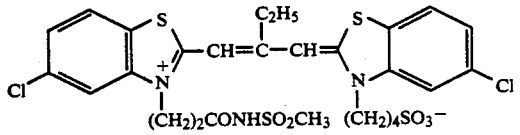
I-4
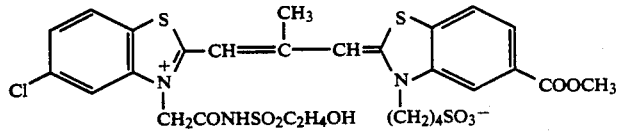
I-5
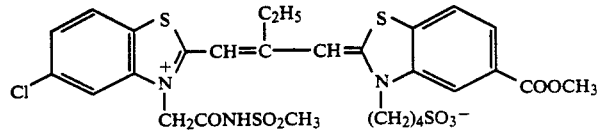
I-6
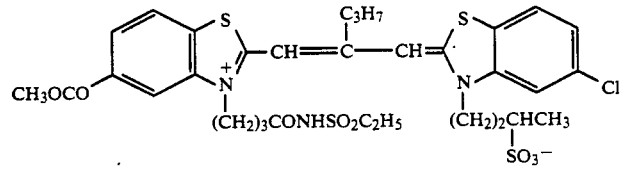
I-7
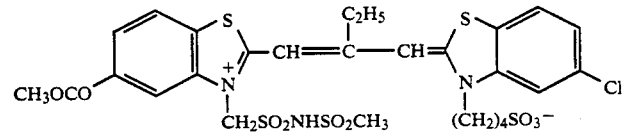
I-8
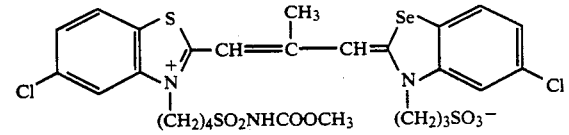
I-9
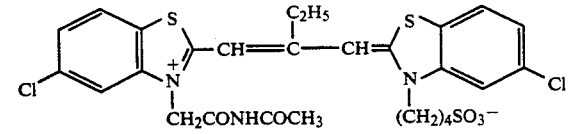
I-10
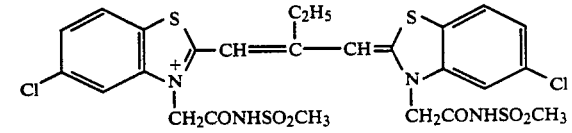
$I^-$
I-11
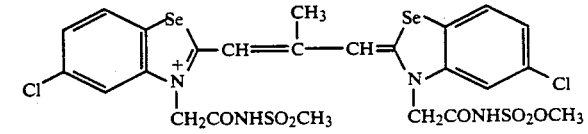
$Br^-$ -continued
II-1
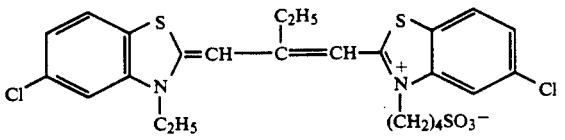
II-2
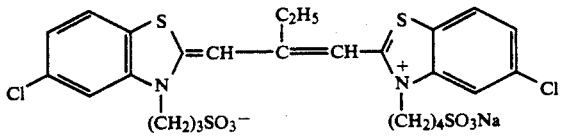
II-3
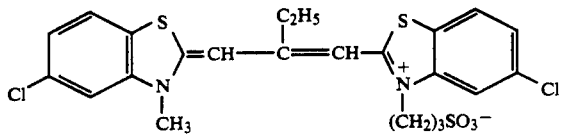
II-4
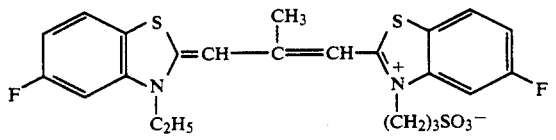
II-5
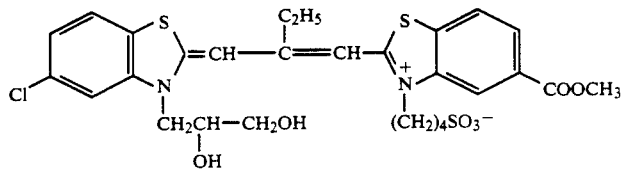
II-6
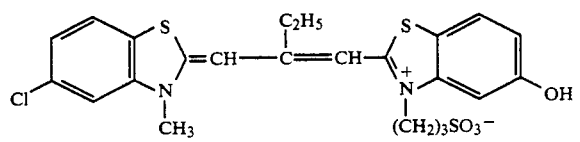
II-7
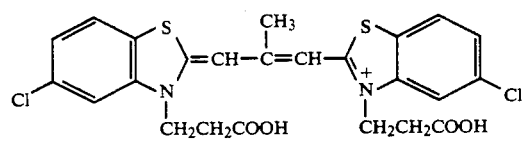
II-8
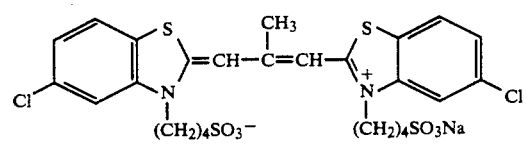
II-9
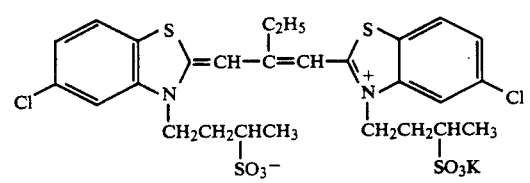
II-10
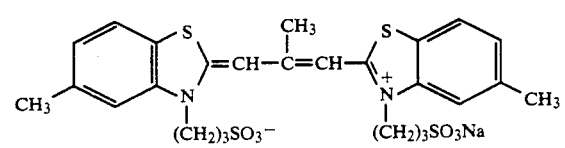

-continued
II-11
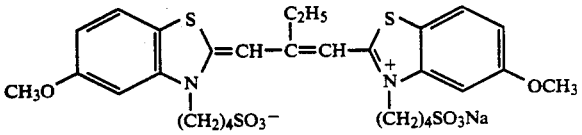
II-12
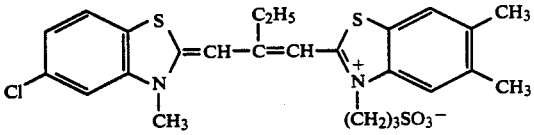
II-13
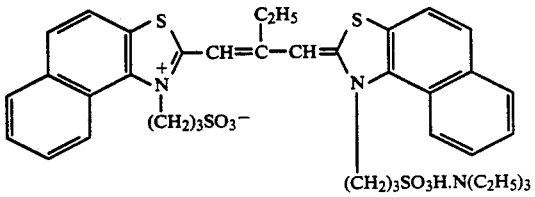
II-14
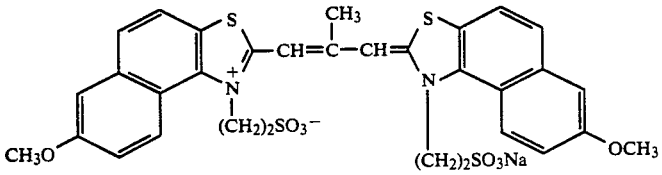
II-15
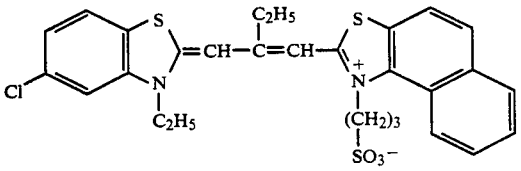
II-16
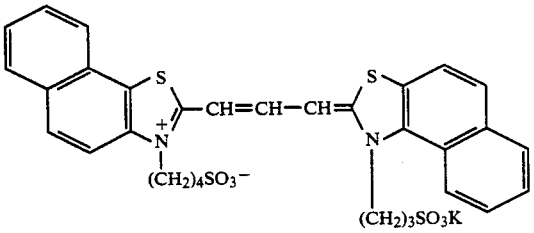
III-1
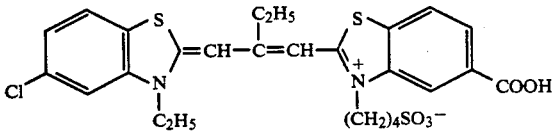
III-2
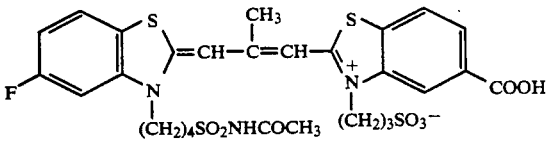
III-3
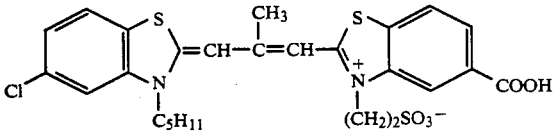

-continued
III-4
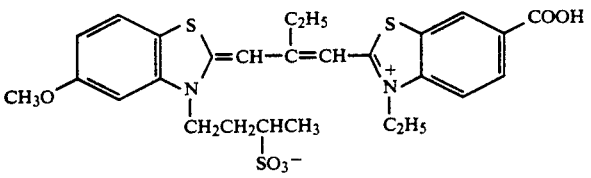
IV-1
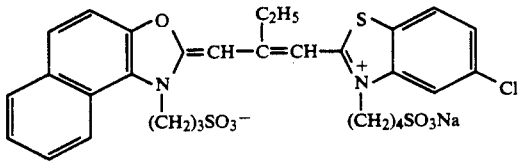
IV-2
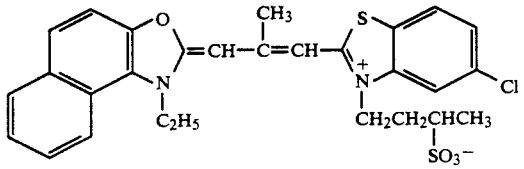
IV-3
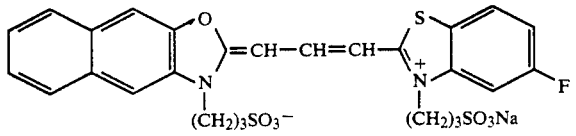
IV-4
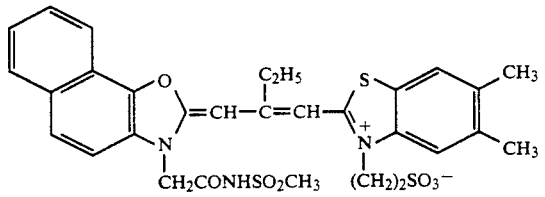
IV-5
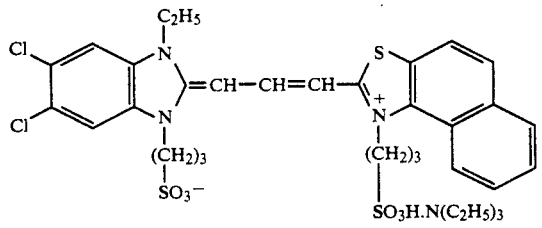
IV-6
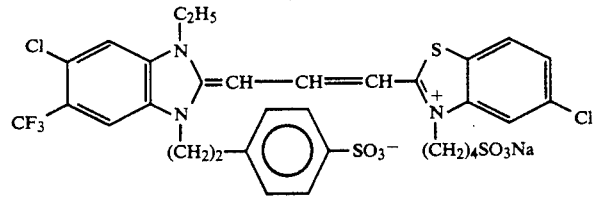
IV-7
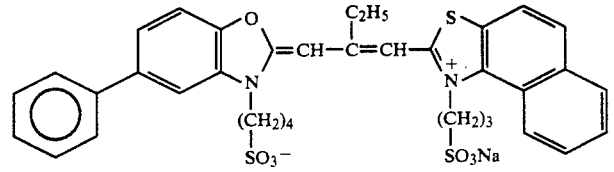

-continued
IV-8
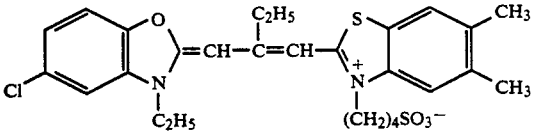
V-1
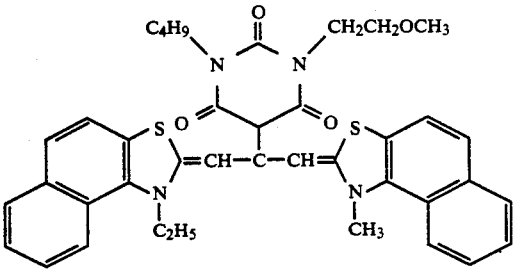
V-2
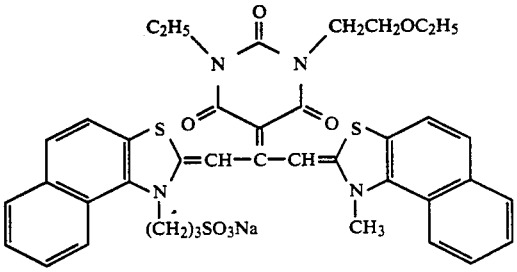
V-3
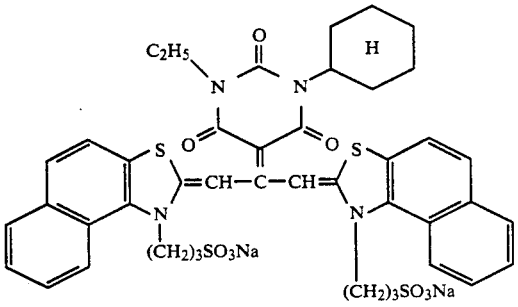
V-4
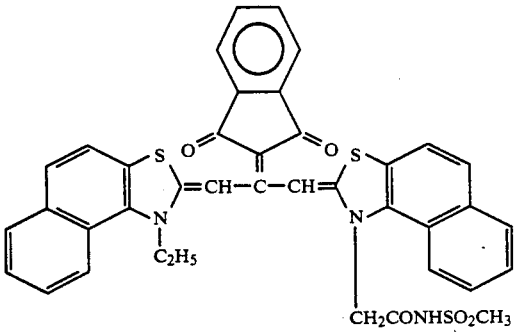
V-5
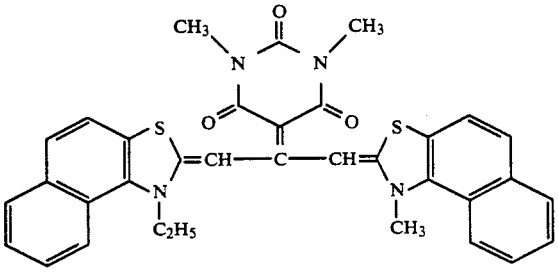

-continued

V-6

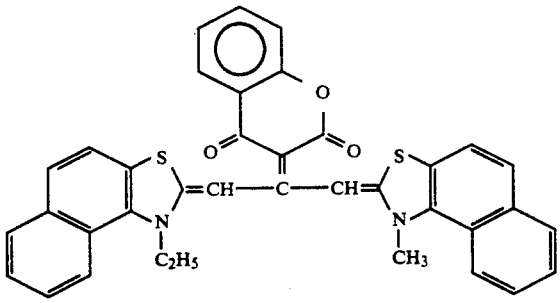

V-7

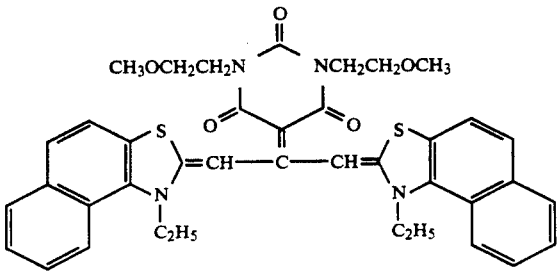

V-8

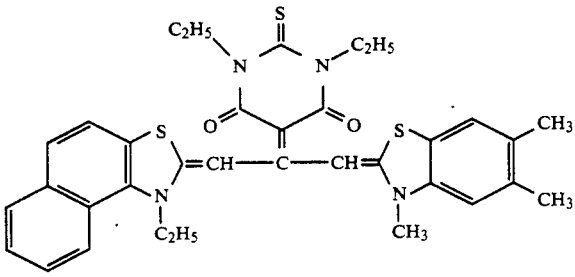

In combination with the methine dyes of general formulae (I) to (V) of the present invention, a dye which does not exhibit a spectral sensitizing effect itself or a substance which does not substantially absorb visible light but exhibits a supersensitizing effect can be incorporated into the emulsion.

The methine compounds of general formulae (I) to (V) of the present invention may be added to an emulsion at any stage in the preparation of the emulsion which has heretofore been known to be suitable. In general, it may be added between the completion of chemical sensitization and the coating step. As described in U.S. Pat. Nos. 3,628,969, and 4,225,666, it may be added at the same time as the chemical sensitizer to effect spectral sensitization and chemical sensitization at the same time. Alternatively, as described in JP-A-58-113928, it may be added before the chemical sensitization or it may be added before the completion of the precipitation of the silver halide grains to initiate spectral sensitization. Further, as taught in U.S. Pat. No. 4,225,666, the above mentioned compound may be added batchwise, that is, a part of the compound may be added before chemical sensitization and the rest of the compound may be added after the chemical sensitization. As taught in U.S. Pat. No. 4,183,756, it may be added at any stage during the formation of the silver halide grains.

The methine compounds of general formulae (I) to (V) of the present invention can be used in an amount of $4\times10^{-6}$ to $8\times10^{-3}$ in total mole per mole of silver halide. If the grain size of silver halide grains is in a preferred range of 0.2 to 1.2 μm, the amount of the methine compound to be used is preferably in the range of about $5\times10^{-5}$ to $2\times10^{-3}$ mole.

The silver halide emulsion to be used in the present invention may have any grain diameter distribution. The silver halide emulsion preferably has a grain diameter distribution such that the weight of the silver halide grains in the range of ±20% around the maximum grain diameter (average) r is about 60% or more, more preferably 80% or more, of the total weight of the silver halide grains.

The silver halide grains may be in the form of finely divided grains with a diameter of 0.1 μm or less or large size grains with a diameter of up to 10 μm, as calculated in terms of projected area.

The silver halide tc be used in the present invention is silver bromoiodide, silver chloroiodide or silver bromochloroiodide containing 0.1 to 30 mole % of silver iodide, particularly preferably silver bromoiodide or silver bromochloroiodide containing from about 2 mole % to about 25 mole % silver iodide, based on the total silver halide content thereof.

The silver halide grains to be used in the present invention may have a regular crystal form such as cube, octahedron and tetradecahedron, an irregular crystal form such as sphere and tablet, an crystal form having crystal defects such as twinning plane, or be a composite thereof.

The preparation of silver halide emulsion to be used in the present invention can be accomplished by any suitable method as disclosed in *Research Disclosure* Nos. 17643 (December 1978), pp. 22-23, "I. Emulsion preparation and types", 18716 (November 1979), page 648, and 307105 (November 1989), pp. 863–865, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions as disclosed in U.S. Pat. Nos. 3,574,628, and 3,655,394, and British Patent 1,413,748 may be preferably used.

Further, emulsions in which silver halide grains with an aspect ratio (ratio of diameter as calculated in terms of circle/thickness of silver halide grains) of about 3 or more are present in a proportion of 50% or more by area of all the silver halide grains can be used. Tabular grains can be easily prepared by the methods disclosed in Gutoff, *Photographic Science and Engineering*, vol. 14, pp. 248–257 (1970), U.S. Pat. Nos. 4,434,226, 4,414,310, 4,433,048, and 4,439,520, and British Patent 2,112,157.

A silver halide emulsion comprising regular grains having a desired size can be obtained by allowing nucleation and grain growth by a double jet process, while the pAg value of the system is kept constant to keep a supersaturation degree such that no renucleation occurs.

Moreover, the methods disclosed in JP-A-54-48521 can be used. Preferred among these methods is a method which comprises adding an aqueous solution of potassium iodide and gelatin and an aqueous solution of an ammoniacal aqueous solution of silver nitride to an aqueous solution of gelatin containing silver halide grains at a rate varying as a function of time. In this method, the time function of adding rate, pH, pAg, temperature, etc., can be properly selected to obtain a silver halide emulsion having a high monodispersibility. This method is further described in *Photographic Science and Engineering*, vol. 6, pp. 159–165 (1962), *Journal of Photographic Science*, vol. 12, pp. 242–251 (1964), U.S. Pat. No. 3,655,394, and British Patent 1,413,748.

The individual silver halide crystals may have either a homogeneous structure or a heterogeneous structure composed of a core and an outer shell differing in halogen composition, or may have a layered structure. These emulsion grains are disclosed in British Patent 1,027,146, U.S. Pat. Nos. 3,505,068, and 4,444,877, and JP-A-60-143331. Further, the grains may have fused thereto a silver halide having a different halogen composition or a compound other than silver halide, e.g., silver thiocyanate, lead oxide, etc., by an epitaxial junction.

The silver halide emulsion of the present invention preferably has a distribution or structure of the halogen composition inside its grains. A typical example of such grains is a core-shell type or double-structure type grain having a halogen composition differing from the core to the shell thereof as disclosed in JP-B 43-13162, JP-B-61-215540, JP-B-60-222845, and JP-A-61-75337.

In addition to the double-structure grain, a triple-structure grain or a higher multi-layer structure grain disclosed in JP-A-60-222844 or a grain having a structure comprising a thin layer with a different silver halide composition coated on the surface of a double-layer (core-shell) structure grain can be used.

Such a structure can be provided inside the grain not only by surrounding the core as mentioned above but also by connecting grains. Examples of such a structure are disclosed in JP-A-59-133540, JP-A-58-108526, and JP-A-59-16254, EP 199290A2, and JP-B-58-24772. Such a structure can be formed by connecting grains having a composition differing from that of a host crystal at the edge, corners or faces of the host crystal. In this case, the host crystal may be homogeneous in halogen composition or may have a core-shell structure.

Such a connection structure can be, of course, formed by the combination of silver halide grains. Such a connection structure can also be formed by the combination of silver halide grain with a silver salt compound other than rock salt, such as silver thiocyanate and silver carbonate. A nonsilver salt compound such as PbO, if it enables a connection structure, may be used.

In silver bromoiodide grains having these structures, e.g., a core-shell structure, the core may have a high silver iodide content while the shell may have a low silver iodide content, and vice versa. Similarly in silver bromoiodide grains having a connection structure, the host crystal may have a high silver iodide content while the crystal to be connected thereto may have a relatively low silver iodide content, and vice versa.

In the grains having these structures, the portions having different halogen compositions have a definite interface or an indefinite interface developed by mixed crystal formed by different halogen compositions, or a positively continuous structure gradation.

The silver halide emulsion to be used in the present invention may be subjected to a grain rounding treatment as disclosed in EP-0096727B1 and EP-0064412B1, or surface modification as disclosed in DE-2306447C2 and JP-A-60-221320.

The silver halide emulsion to be used in the present invention is preferably of the surface latent image type. As disclosed in JP-A-59-133542, an internal latent image type emulsion can be used depending on the kind of the developer or the developing conditions. Further, a shallow internal latent image type grain comprising a thin shell as disclosed in JP-A-63-264740 can be preferably used.

In order to accelerate ripening, a silver halide solvent can be effectively used. For example, it has been known that ripening can be accelerated by allowing an excess amount of halogen ions to be present in the reaction vessel. Therefore, it is obvious that ripening can be accelerated only by introducing a halide solution into the reaction vessel. Other ripening agents can be used. These ripening agents can be entirely blended in the dispersant in the reaction vessel before the addition of silver and halides. Alternatively, these ripening agents can be introduced into the reaction vessel at the same time as the addition of one or more halides, silver salts or deflocculating agents. In another modified embodiment, the ripening agent can be introduced into the reaction vessel separately of the halides and silver salts at the step of addition thereof.

As ripening agents other than halogen ion there can be used ammonia, amine compounds, and thiocyanates such as thiocyanates of alkali metal, particularly sodium thiocyanate and potassium thiocyanate, and ammonium thiocyanate.

Chemical sensitization can be effected with an active gelatin as described in T. H. James, *The Theory of the Photographic Process*, 4th ed., MacMillan, 1977, pp. 67–76. Alternatively, chemical sensitization can be effected with sulfur, selenium, tellurium, gold, platinum, palladium, iridium or a combination of a plurality of such sensitizers at a pAg value of 5 to 10 and a pH value of 5 to 8 and a temperature of 30° to 80° C. as described in *Research Disclosure* Nos. 12008, vol. 120, April 1974, and 13452, vol. 134, June 1975, U.S. Pat. Nos. 2,642,361, 3,297,446, 3,772,031, 3,857,711, 3,901,714, 4,266,018, and 3,904,415, and British Patent 1,315,755. An optimum chemical sensitization can be effected in the presence of a gold compound and a thiocyanate compound or in the presence of a sulfur-containing compound or sulfur-containing compounds such as hypo, thiourea compounds and rhodanine compounds, as described in U.S. Pat. Nos. 3,857,711, 4,266,018, and 4,054,457. Chemical sensitization can be effected in the presence of a chemical sensitization aid. As such a chemical sensitization aid there can be used a compound which is known to inhibit fog during chemical sensitization while increasing sensitivity, such as azaindene, azapyridazine and azapyrimidazine. Examples of chemical sensitization aid improvers are described in U.S. Pat. Nos. 2,131,038, 3,411,914, and 3,554,757, JP-A-58-126526, and the above cited G. F. Duffin, *Photographic Emulsion Chemistry*, pp. 138–143.

The photographic emulsion to be used in the present invention can comprise various compounds for the purpose of inhibiting fogging during the preparation, storage or photographic processing of the light-sensitive material or for stabilizing the photographic properties. In particular, there can be used many compounds known as fog inhibitors or stabilizers. Examples of these fog inhibitors or stabilizers include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothidiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds such as oxadolinethione, azaindenes such as triazaindenes, tetraazaindenes (particularly 4-hydroxy-substituted (1,3,3a,7)tetraazaindenes), and pentaazaindenes. For example, those described in U.S. Pat. Nos. 3,954,474, and 3,982,947, and JP-B-52-28660 can be used.

In the light-sensitive material of the present invention, the above mentioned various additives can be used. In addition to these additives, other various additives can be used depending on the purpose.

These additives are further described in *Research Disclosure* Nos. 17643 (December 1978) and 18716 (November 1979) as tabulated below.

| | Kind of additive | RD17643 | RD18716 |
|---|---|---|---|
| 1. | Chemical sensitizer | | p. 648, right column (RC) |
| 2. | Sensitivity increasing agent | | p. 648, right column (RC) |
| 3. | Spectral sensitizer and supersensitizer | pp. 23–24 | p. 648, RC–p. 649, RC |
| 4. | Brightening agent | p. 24 | |
| 5. | Antifoqqant and stabilizer | pp. 24–25 | p. 649, RC |
| 6. | Light absorbent, filter dye, and ultraviolet absorbent | pp. 25–26 | p. 649, RC–p. 650, left column (LC) |
| 7. | Stain inhibitor | p. 25, RC | p. 650, LC–RC |
| 8. | Dye image stabilizer | p. 25 | |
| 9. | Hardening agent | p. 26 | p. 651, LC |
| 10. | Binder | p. 26 | " |
| 11. | Plasticizer and lubricant | p. 27 | p. 650, RC |
| 12. | Coating aid and surface active agent | pp. 26–27 | " |
| 13. | Antistatic agent | p. 27 | " |

Various color couplers can be used in the present invention. Specific examples of the color couplers are described in the patents cited in the above cited *Research Disclosure* No. 17643, VII-C to G.

Preferred yellow couplers include those described in U.S. Pat. Nos. 3,933,501, 4,022,620, 4,326,024, and 4,401,752, JP-B-58-10739, and British Patents 1,425,020, and 1,476,760.

Preferred magenta couplers include 5-pyrazolone compounds and pyrazoloazole compounds. Particularly preferred are those described in U.S. Pat. Nos. 4,310,619, 4,351,897, 3,061,432, 3,725,067, 4,500,630, and 4,540,654, *Research Disclosure* Nos. 24220 (June 1984) and 24230 (June 1984), European Patent 73,636, JP-A-60-33552, and JP-A-60-43659.

Cyan couplers include phenol and naphthol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,451,559, and 4,427,767, German Patent (OLS) No. 3,329,729, and European Patents 121,365A, and 161,626A.

Colored couplers for correction of unnecessary absorptions of the developed color preferably include those described in *Research Disclosure* No. 17643, VII-G, U.S. Pat. Nos. 4,163,670, 4,004,929, and 4,138,258, JP-B-57-39413, and British Patent 1,146,368.

Couplers which form a dye having moderate diffusibility preferably include those described in U.S. Pat. No. 4,366,237, British Patent 2,125,570, European Patent 96,570, and German Patent (OLS) No. 3,234,533.

Typical examples of polymerized dye-forming couplers are described in U.S. Pat. Nos. 3,451,820, 4,080,211, and 4,367,282, and British Patent 2,102,173.

Couplers capable of releasing a photographically useful residual group upon coupling can also be used in the present invention. Preferred examples of DIR couplers which release a developing inhibitor are described in the patents cited in RD 17643, VII-F, JP-A-57-151944, JP-A-57-154234, and JP-A-60-184248, and U.S. Pat. No. 4,248,962.

Couplers capable of imagewise releasing a nucleating agent or a developing accelerator at the time of development preferably include those described in British Patents 2,097,140, and 2,131,188, JP-A-59-157638, and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound- or DIR coupler-releasing couplers or DIR coupler-releasing redox compounds as described in JP-A-60-185950 and JP-A-62-24252, couplers capable of releasing a dye which returns to its original color after release as described in European Patent 173,302A, couplers capable of releasing a bleach accelerators as described in RD Nos. 11449 and 24241, and JP-A-61-201247, and couplers capable of releasing a ligand as described in U.S. Pat. No. 4,553,477.

The incorporation of these couplers into the light-sensitive material can be accomplished by any suitable known dispersion method.

Examples of high boiling solvents to be used in the oil-in-water dispersion process are described in U.S. Pat. No. 2,322,027.

Specific examples of high boiling organic solvents having a boiling point of 175° C. or higher at atmospheric pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyl diphenyl phosphate, tricyclohexyl, tri-2-ethylhexyl phosphate, tridecyl phosphate, tributoxyethyl phosphate, trichloropropyl phosphate, di-2-ethylhexylphenyl phosphonate), benzoic esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic esters (e.g., bis(2-ethylhexyl) sebacate, dioctyl azerate, glycerol tributylate, isostearyl lactate, trioctyl citrate), aniline derivatives (N,N-dibutyl-2-butoxy-5-tert-octylaniline), and hydrocarbons (e.g., paraffin, dodecylbenzene, diisopropylnaphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of the latex dispersion method and specific examples of latexes to be used in dipping are described in U.S. Pat. No. 4,199,363, and German Patent (OLS) Nos. 2,541,274, and 2,541,230.

The present invention is applicable to various types of color light-sensitive materials, particularly preferably to color negative films for common use or motion pictures, color reversal films for slide or television, color papers, color positive films and color reversal papers. The present invention can also be used for black-and-white photographic materials, X-ray light-sensitive materials and printing light-sensitive materials to provide excellent results.

If the present invention is used for color light-sensitive material for picture taking, it can be applied to a light-sensitive material obtained by the combination of light-sensitive materials in various structures, layer structures and special coloring materials.

Typical examples of such a combination include a combination of coupling rate of color couplers, diffusibility and layer structures as disclosed in JP-B-47-49031, JP-B-49-3843, and JP-B-50-21248, and JP-A-59-58147, JP-A-59-60437, JP-A-60-227256, JP-A-61-4043, JP-A-61-43743, and JP-A-61-42657, a structure comprising two or more layers having the same color sensitivity as described in JP-B-49-15495, and U.S. Pat. No. 3,843,469, and a structure in which the location of high sensitivity layers, low sensitivity layers and layers having different color sensitivities is specified as described in JP-B-53-37017, JP-B-53-37018, JP-A-51-49027, JP-A-52-143016, JP-A-53-97424, JP-A-53-97831, JP-A-62-200350, and JP-A-59-177551.

Suitable supports which can be used in the present invention are described in the above cited RD No. 17643 (page 28) and 18716 (right column on page 647 to left column on page 648).

The color photographic light-sensitive material according to the present invention can be developed by ordinary methods as described in the above cited RD Nos. 17643 (pp. 28–29) and 18716 (left column to right column on page 651).

Color developers to be used for development processing of light-sensitive materials according to the present invention preferably include alkaline aqueous solutions containing as a main component an aromatic primary amine developing agent. Suitable color developing agents include aminophenol compounds, and preferably p-phenylenediamine compounds. Typical examples of the latter are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates thereof. These compounds may be used in combination of two or more thereof according to the purpose.

The color developer generally contains pH buffers such as carbonates, borates or phosphates of alkali metals, and developing inhibitors or antifoggants, such as bromides, iodides, benzimidazoles, benzothiazoles, and mercapto compounds. If desired, the color developer may further contain various preservatives, e.g., hydroxylamine, diethylhydroxylamine, hydrazine sulfites, phenylsemicarbazides, triethanolamine, catecholsulfonic acids, and triethylenediamine (1,4-diazabicyclo[2,2,-2]octane); organic solvents, e.g., ethylene glycol and diethylene glycol; development accelerators, e.g., benzyl alcohol, polyethylene glycol, quaternary ammonium salts, and amines; color-forming couplers; competing couplers; fogging agents, e.g., sodium boron hydride; auxiliary developing agents, e.g., 1-phenyl-3-pyrazolidone; viscosity-imparting agents; various chelating agents exemplified by aminopolycarboxylic acids, aminopolyphosphonic acids, alkylphosphonic acids, and phosphonocarboxylic acids, e.g., ethylenetriaminepentaacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

Reversal processing is usually carried out by black-and-white development followed by color development. Black-and-white developers to be used can contain one or more known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to thereby prevent evaporation and air-oxidation of the liquid. The replenishment rate can also be reduced by a means for suppressing accumulation of the bromide ion in the developer.

The color development time is usually selected between 2 minutes and 5 minutes. By carrying out the color development at a high temperature and a high pH with a high concentration of a color developing agent, the development time can be further reduced.

The photographic emulsion layer which has been color developed is usually subjected to bleach. Bleach may be effected simultaneously with fixation (i.e., blix), or these two steps may be carried out separately. For speeding up processing, bleach may be followed by blix. Furthermore, any of an embodiment wherein two blix baths is preceded by fixation, and an embodiment wherein blix is followed by bleach may be selected arbitrarily according to the purpose. Bleaching agents to be used include compounds of polyvalent metals, e.g., iron (III), cobalt (III), chromium (VI), and copper (II), peracids, quinones, nitroso compounds, and the like. Typical examples of these bleaching agents are ferricyanides; bichromates; organic complex salts of iron (III) or cobalt (III), such as complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc.; persulfates; hydrobromic acid salts; permanganates; nitrobenzenes; and so on. Of these, aminopolycarboxylic acid-iron (III) complex salts such as (ethylenediaminetetraacetato)iron (III) complex salts and persulfates are preferred to speed up processing and conserve the environment. In particular, (ethylenediaminetetraacetato)iron (III) complex salts are useful in both a bleaching solution and a blix solution. The bleaching or blix solution usually has a pH of from 5.5 to 8. For speeding up processing, it is possible to adopt a lower pH value.

The bleaching bath, blix bath or a prebath thereof can contain, if desired, a bleaching accelerator. Examples of useful bleaching accelerators are compounds having a mercapto group or a disulfide group described in U.S. Pat. No. 3,893,858, German Patents 1,290,812, and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (July 1978), thiazolidine derivatives described in JP-A-50-140129, thiourea derivatives described in JP-B-45-8506, JP-A-52-20832, JP-A-53-32735, and U.S. Pat. No. 3,706,561, iodides described in German Patent 1,127,715, and JP-A-58-16235, polyoxyethylene compounds described in German Patents 966,410, and 2,748,430, polyamine compounds described in JP-B-45-8836, compounds described in JP-A-49-42434, JP-A-49-59644, JP-A-53-94927, JP A-54-35727, JP-A-55-26506, and JP-A-58-163940, and bromine ions. Preferred among them are compounds having a mercapto group or a disulfide group because of their great acceleratory effects. In particular, the compounds disclosed in U.S. Pat. No. 3,893,858, German Patent 1,290,812, and JP A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for photographing.

Fixing agents to be used for fixation include thiosulfates, thiocyanates, thioethers, thioureas, and a large amount of iodides. The thiosulfates are usually employed, with ammonium thiosulfate being applicable most broadly. Sulfites, bisulfites or carbonyl bisulfite adducts are suitably used as preservatives of the blix bath.

It is usual that the silver halide color photographic materials of the present invention are subjected to washing and/or stabilization after desilvering. The amount of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or concurrent-flow system), and other various factors. Of these factors, the relationship between the number of washing tanks and the amount of water in a multi-stage counter-flow system can be obtained according to the method described in *Journal of the Society of Motion Picture and Television Engineers*, vol. 64, pp. 248–253 (May 1955).

According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Furthermore, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, Bokinbobaizai no Kagaku, Eisei Gijutsukai (ed.), Bokinbobaizai no Kagaku, Bobigijutsu, and Nippon Bokin Bobi Gakkai (ed.), Bokin Bobizai Jiten.

The washing water has a pH of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the present invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases, for example, a stabilizing bath containing formaldehyde and a surface active agent as is used as a final bath for color light-sensitive materials for photographing. This stabilizing bath may also contain various chelating agents or bactericides.

The overflow accompanying replenishment of the washing bath and/or stabilizing bath can be reused in other steps such as desilvering.

For the purpose of simplifying and speeding up processing, the silver halide color photographic material of the present invention may comprise a color developing agent. Such a color developing agent is preferably used in the form of various precursors. Examples of such precursors include indoaniline compounds as described in U.S. Pat. No. 3,342,597, Schiff base type compounds as described in *Research Disclosure* Nos. 14850 and 15159, aldol compounds as described in *Research Disclosure* No. 13924, metal complexes as described in U.S.

Pat. No. 3,719,492, and urethane compounds as described in JP-A-53-135628.

For the purpose of accelerating color development, the silver halide color light-sensitive material of the present invention may comprise various 1-phenyl-3-pyrazolidones as necessary. Typical examples of such compounds are described in JP-A-56-64339, JP-A-57-144547, and JP-A-58-115438.

The various processing solutions to be used in the present invention are used at a temperature of 10° to 50° C. The standard temperature range is from 33° C. to 38° C. However, a higher temperature range can be used to accelerate processing, thereby shortening the processing time. On the contrary, a lower temperature range can be used to improve the picture quality or the stability of the processing solutions. In order to save the amount of silver to be incorporated in the light-sensitive material, a processing utilizing cobalt intensification or hydrogen peroxide intensification described in German Patent 2,226,770 or U.S. Pat. No. 3,674,499 can be effected.

The silver halide photographic material of the present invention can also be applied to heat-developable light-sensitive materials as described in U.S. Pat. No. 4,500,626, JP-A-60-133449, JP-A-59-218443, JP-A-61-238056, and European Patent 210,660A2.

The present invention will be further described in the following examples, but the present invention should not be construed as being limited thereto.

EXAMPLE 1

Preparation of Specimen No. 101

Onto a 127-μm thick subbed cellulose triacetate film support were coated the following layer compositions to prepare a multi-layer color light-sensitive material as Specimen No. 101. The figure indicates the amount added in g per $m^2$. The actual effects of the compounds added are not limited to those described.

| | |
|---|---|
| 1st layer: antihalation layer | |
| Black colloidal silver | 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High boiling organic solvent Oil-1 | 0.1 g |
| Solid dispersion of microcrystal of Dye E-1 | 0.1 g |
| 2nd layer: interlayer | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.4 mg |
| 3rd layer: interlayer | |
| Superficially and internally fogged fine emulsion of silver bromoiodide (average grain diameter: 0.06 μm; fluctuation coefficient: 18%; AgI content: 1 mole %) | 0.05 g as calculated in terms of silver |
| Gelatin | 0.4 g |
| 4th layer: low sensitivity red-sensitive emulsion layer | |
| Emulsion A | 0.1 g as calculated in terms of silver |
| Emulsion B | 0.4 g as calculated in terms of silver |
| Gelatin | 0.8 g |

-continued

| | |
|---|---|
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High boiling organic solvent Oil-2 | 0.1 g |
| Additive P-1 | 0.1 g |
| 5th layer: middle sensitivity red-sensitive emulsion layer | |
| Emulsion B | 0.2 g as calculated in terms of silver |
| Emulsion C | 0.3 g as calculated in terms of silver |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Additive P-1 | 0.1 g |
| 6th layer: high sensitivity red-sensitive emulsion layer | |
| Emulsion D | 0.4 g as calculated in terms of silver |
| Gelatin | 1.1 g |
| Coupler C-1 | 0.3 g |
| Coupler C-2 | 0.1 g |
| Coupler C-3 | 0.7 g |
| Additive P-1 | 0.1 g |
| 7th layer: interlayer | |
| Gelatin | 0.6 g |
| Additive M-1 | 0.3 g |
| Color stain inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High boiling organic solvent Oil-1 | 0.02 g |
| 8th layer: interlayer | |
| Superficially and internally fogged fine emulsion of silver bromoiodide (average grain diameter: 0.06 μm; fluctuation coefficient: 16%; AgI content: 0.3 mole %) | 0.02 g as calculated in terms of silver |
| Gelatin | 1.0 g |
| Additive P-1 | 0.2 g |
| Color stain inhibitor Cpd-A | 0.1 g |
| 9th layer: low sensitivity green-sensitive emulsion layer | |
| Emulsion E | 0.1 g as calculated in terms of silver |
| Emulsion F | 0.2 g as calculated in terms of silver |
| Emulsion G | 0.2 g as calculated in terms of silver |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High boiling organic solvent Oil-1 | 0.1 g |
| High boiling organic solvent Oil-2 | 0.1 g |
| 10th layer: middle sensitivity green-sensitive emulsion layer | |
| Emulsion G | 0.3 g as calculated |

-continued

| | |
|---|---|
| | in terms of silver |
| Emulsion H | 0.1 g as calculated in terms of silver |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High boiling organic solvent Oil-2 | 0.1 g |
| 11th layer: high sensitivity green-sensitive emulsion layer | |
| Emulsion I | 0.5 g as calculated in terms of silver |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High boiling organic solvent Oil-1 | 0.02 g |
| High boiling organic solvent Oil-2 | 0.02 g |
| 12th layer: interlayer | |
| Gelatin | 0.6 g |
| 13th layer: yellow filter layer | |
| Yellow colloidal silver | 0.07 g as calculated in terms of silver |
| Gelatin | 1.1 g |
| Color stain inhibitor Cpd-A | 0.01 g |
| High boiling organic solvent Oil-1 | 0.01 g |
| Solid dispersion of microcrystal of Dye E-2 | 0.05 g |
| 14th layer: interlayer | |
| Gelatin | 0.6 g |
| 15th layer: low sensitivity blue-sensitive emulsion layer | |
| Emulsion J | 0.2 g as calculated in terms of silver |
| Emulsion K | 0.3 g as calculated in terms of silver |
| Emulsion L | 0.1 g as calculated in terms of silver |
| Gelatin | 0.8 g |
| Coupler C-5 | 0.2 g |
| Coupler C-6 | 0.1 g |
| Coupler C-10 | 0.4 g |

-continued

| | |
|---|---|
| 16th layer: middle sensitivity blue-sensitive emulsion layer | |
| Emulsion L | 0.1 g as calculated in terms of silver |
| Emulsion M | 0.4 g as calculated in terms of silver |
| Gelatin | 0.9 g |
| Coupler C-5 | 0.3 g |
| Coupler C-6 | 0.1 g |
| Coupler C-10 | 0.1 g |
| 17th layer: high sensitivity blue-sensitive emulsion layer | |
| Emulsion N | 0.4 g as calculated in terms of silver |
| Gelatin | 1.2 g |
| Coupler C-5 | 0.3 g |
| Coupler C-6 | 0.6 g |
| Coupler C-10 | 0.1 g |
| 18th layer: 1st protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Formaldehyde scavenger Cpd-H | 0.4 g |
| Dye D-1 | 0.1 g |
| Dye D-2 | 0.05 g |
| Dye D-3 | 0.1 g |
| 19th layer: 2nd protective layer | |
| Colloidal silver | 0.1 mg as as calculated in terms of silver |
| Fine emulsion of silver bromoiodide (average grain diameter: 0.06 μm; AgI content: 1 mole %) | 0.1 g as as calculated in terms of silver |
| Gelatin | 0.4 g |
| 20th layer: 3rd protective layer | |
| Gelatin | 0.4 g |
| Polymethyl methacrylate (average grain diameter: 1.5 μm) | 0.1 g |
| 4:6 Copolymer of methyl methacrylate and acrylic acid (average grain diameter: 1.5 μm) | 0.1 g |
| Silicone oil | 0.03 g |
| Surface active agent W-1 | 3.0 mg |
| Surface active agent W-2 | 0.03 g |

In addition to the above mentioned compositions, additives F-1 to F-8 were incorporated into all these emulsion layers. Besides the above mentioned compositions, a gelatin hardener H-1 and coating and emulsifying surface active agents W-3, W-4, W-5 and W-6 were incorporated into each of the various layers.

Further, phenol, 1,2-benzisothiazolin-3-one, 2-phenoxyethanol, and phenethyl alcohol were incorporated into these layers as preservatives or mildewproofing agents.

Silver bromoiodide emulsions used in Specimen No. 101 were as follows:

TABLE 1

| Emulsion | Feature of grain | Average grain diameter (μm) in terms of sphere | Fluctuation coefficient (%) | AgI content (%) |
|---|---|---|---|---|
| A | Monodisperse tetradecahedral grain | 0.28 | 16 | 3.7 |
| B | Monodisperse cubic internal latent image type grain | 0.30 | 10 | 3.3 |
| C | Monodisperse tabular grain; average aspect ratio: 4.0 | 0.38 | 18 | 5.0 |
| D | Tabular grain; average aspect ratio: 8.0 | 0.68 | 25 | 2.0 |
| E | Monodisperse cubic grain | 0.20 | 17 | 4.0 |
| F | Monodisperse cubic grain | 0.23 | 16 | 4.0 |
| G | Monodisperse cubic internal latent image type grain | 0.28 | 11 | 3.5 |
| H | Monodisperse cubic internal latent image type grain | 0.32 | 9 | 3.5 |

TABLE 1-continued

| Emulsion | Feature of grain | Average grain diameter (μm) in terms of sphere | Fluctuation coefficient (%) | AgI content (%) |
|---|---|---|---|---|
| I | Tabular grain; average aspect ratio: 9.0 | 0.80 | 28 | 1.5 |
| J | Monodisperse tetradecahedral grain | 0.30 | 18 | 4.0 |
| K | Monodisperse tabular grain; average aspect ratio: 7.0 | 0.45 | 17 | 4.0 |
| L | Monodisperse cubic internal latent image type grain | 0.46 | 14 | 3.5 |
| M | Monodisperse tabular grain; average aspect ratio: 10.0 | 0.55 | 13 | 4.0 |
| N | Tabular grain; average aspect ratio: 12.0 | 1.00 | 33 | 1.3 |

TABLE 2

(spectral sensitization of Emulsions A–N)

| Emulsion | Added sensitizing dye | Amount (g) added per mole of silver halide |
|---|---|---|
| A | II-1 | 0.285 |
| B | II-1 | 0.27 |
| C | II-1 | 0.28 |
| D | II-1 | 0.27 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

C-1

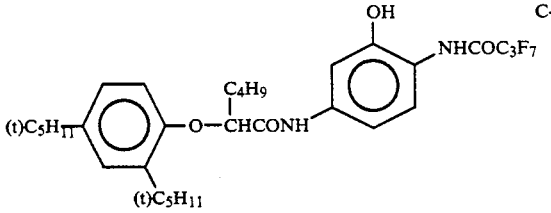

C-2

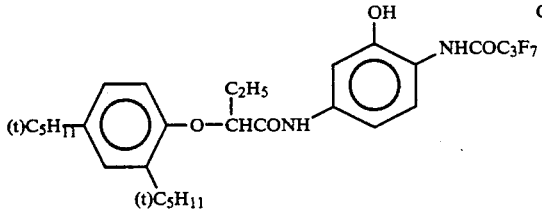

C-3

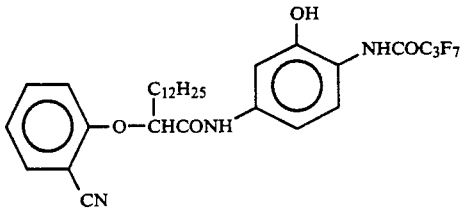

-continued

C-4

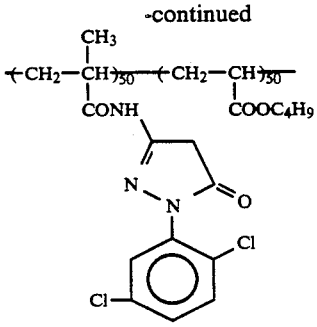

Figure indicates wt. %
Average molecular weight: approx. 25,000

C-5

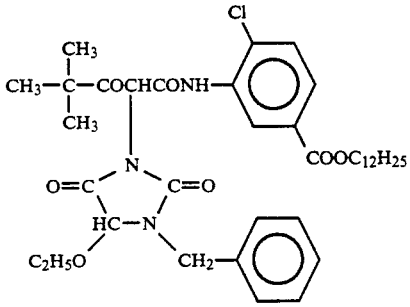

C-6

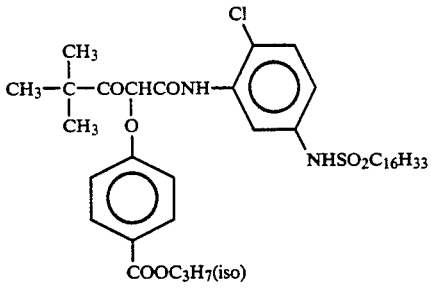

C-7

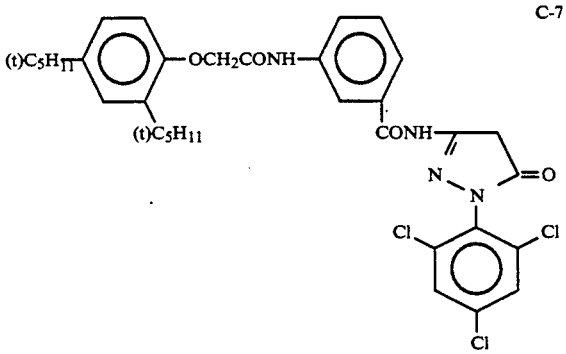

-continued
C-8
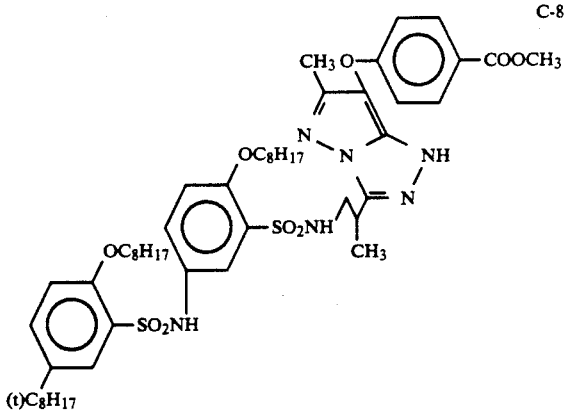
C-9
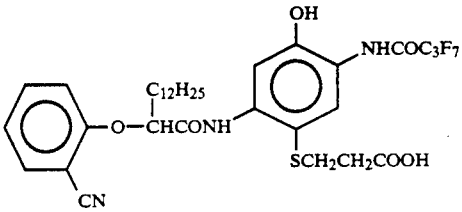
C-10
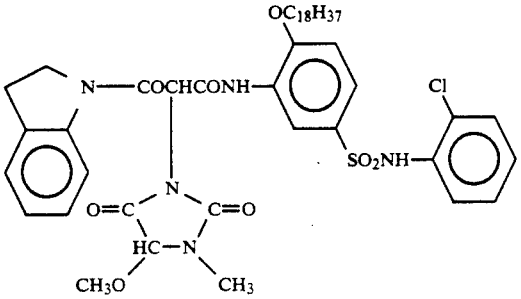
Dibutyl phthalate — Oil-1
Tricresyl phosphate — Oil-2
Oil-3
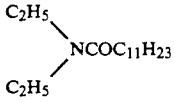
Cpd-A
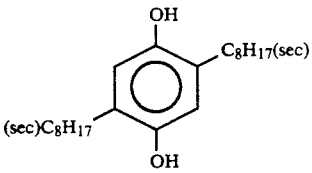
Cpd-B
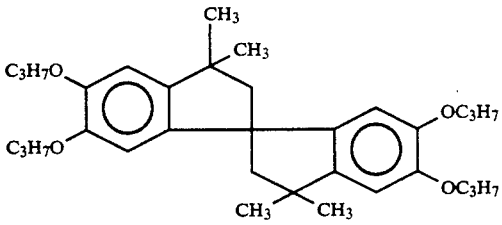
Cpd-C
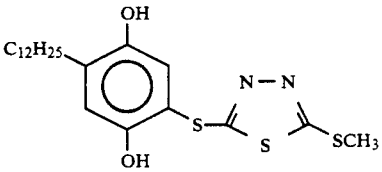
-continued
Cpd-D
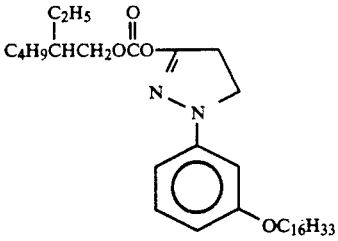
Cpd-E
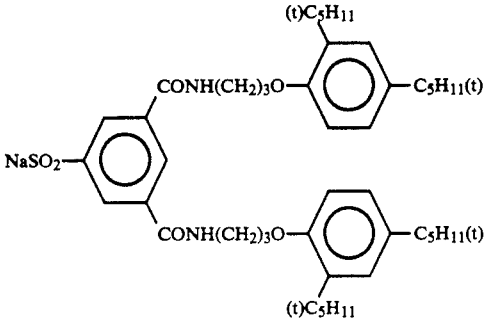
Cpd-F
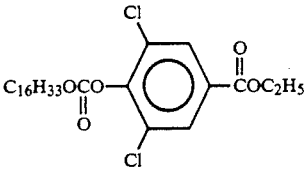
Cpd-G
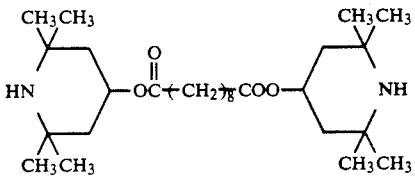
Cpd-H
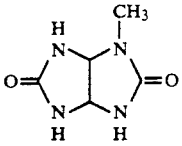
Cpd-I
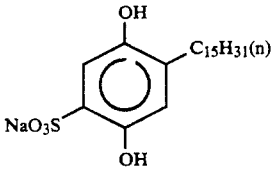
Cpd-J
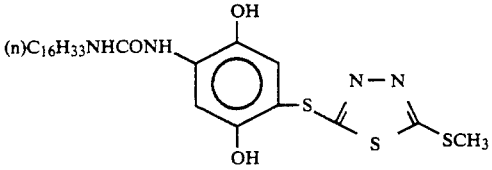

-continued
Cpd-K
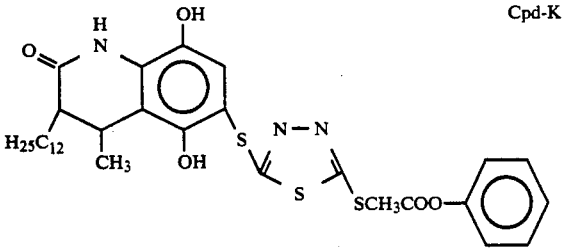
U-1
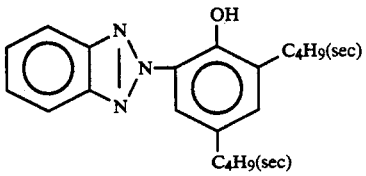
U-2
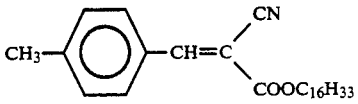
U-3
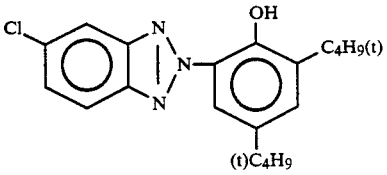
U-4
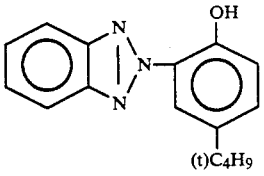
U-5
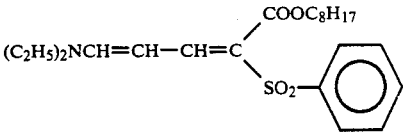
S-3
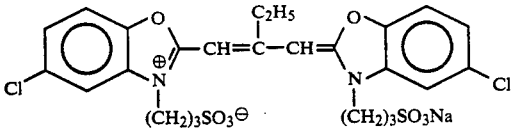
S-4
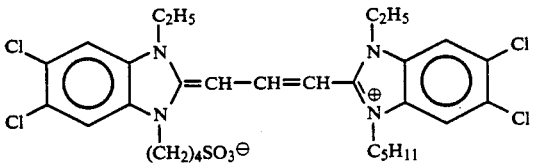
S-5
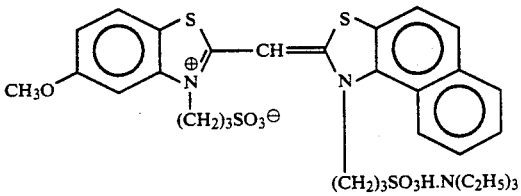
-continued
S-6
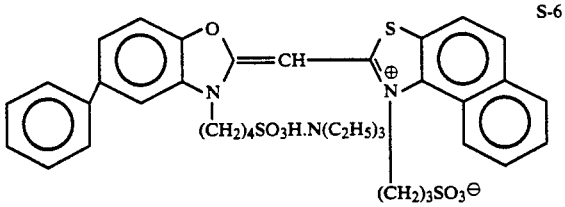
S-8
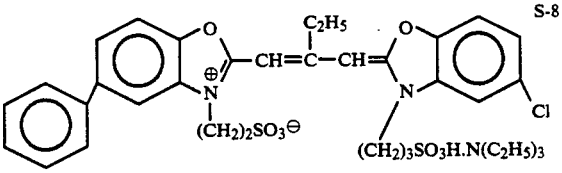
D-1
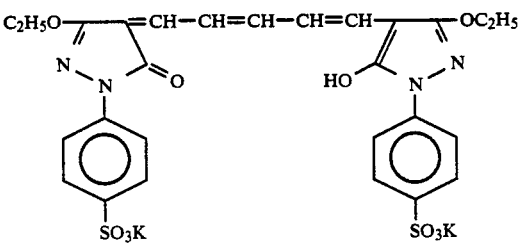
D-2
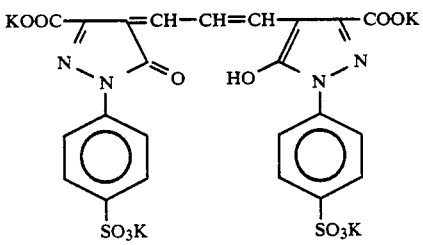
D-3
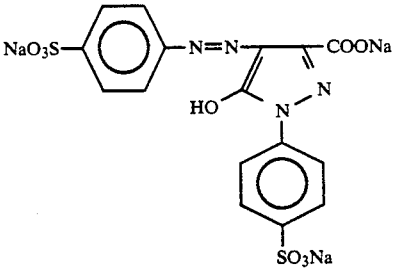
D-4
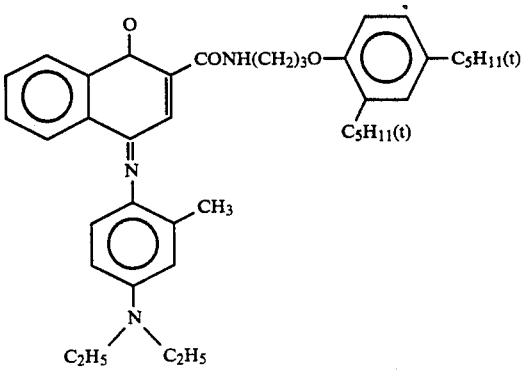

-continued

E-1

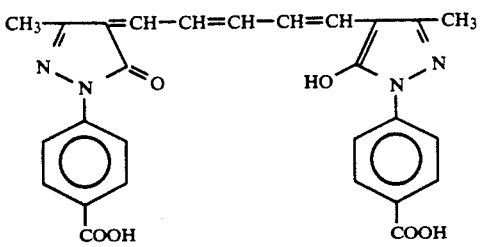

E-2

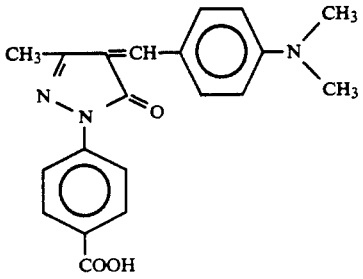

H-1

$CH_2{=}CH{-}SO_2{-}CH_2{-}CONH{-}CH_2$
$CH_2{=}CH{-}SO_2{-}CH_2{-}CONH{-}CH_2$

W-1

$C_8F_{17}SO_2NHCH_2CH_2CH_2OCH_2CH_2\overset{\oplus}{N}(CH_3)_3$

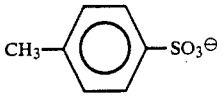

W-2

$C_8F_{17}SO_2N(C_3H_7)CH_2COOK$

W-3

$NaO_3S{-}CH(CH_2COOCH_2CH(C_2H_5)C_4H_9){-}COOCH_2CH(C_2H_5)C_4H_9$

W-4

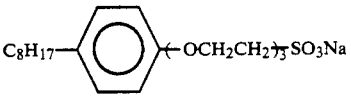

W-5

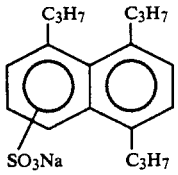

W-6

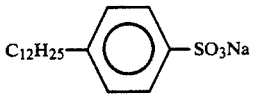

P-1

$\left(CH_2{-}CH(CONHC_4H_9(t))\right)_n$

M-1

$\left(CH_2{-}CH(COOC_4H_9)\right)_n$

-continued

F-1

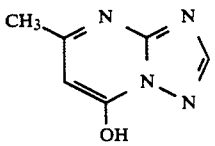

F-2

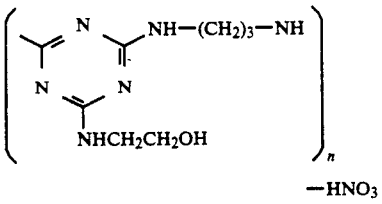

F-3

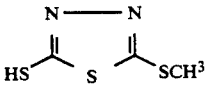

F-4

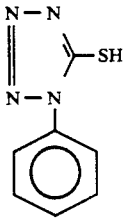

F-5

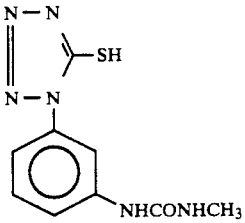

F-6

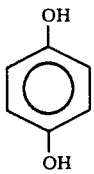

F-7

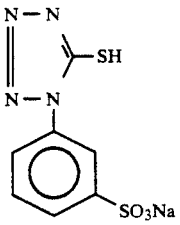

F-8

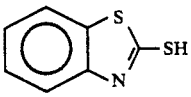

Preparation of Specimen Nos. 102–119

Specimen Nos. 102 to 119 were prepared in the same manner as Specimen No. 101 except that the sensitizing dyes to be incorporated into Emulsions A to D were replaced by the sensitizing dyes as set forth in Table 3, respectively.

These specimens were exposed to white light at an exposure of 20 CMS through a gray wedge for 1/100 seconds, processed according to the processing steps described below, and then subjected to sensitometry.

For the evaluation of color remaining, the magenta stain density of Specimen No. 119 (free of dyes) was subtracted from the magenta density on the stained portion of the specimens which had been processed.

TABLE 3

| Specimen No. | Emulsion A Sensitizing dye | Emulsion A Added amount (g/mole Ag) | Emulsions B and D Sensitizing dye | Emulsions B and D Added amount (g/mole Ag) | Emulsion C Sensitizing dye | Emulsion C Added amount (g/mole Ag) |
|---|---|---|---|---|---|---|
| 101 (comparative) | II-1 | 0.285 | II-1 | 0.27 | II-1 | 0.28 |
| 102 (comparative) | I-1 | 0.285 | I-1 | 0.27 | I-1 | 0.28 |
| 103 (present invention) | I-1 | 0.26 | I-1 | 0.26 | I-1 | 0.26 |
| | V-1 | 0.025 | V-1 | 0.01 | V-1 | 0.02 |
| 104 (present invention) | I-9 | 0.25 | I-9 | 0.25 | I-9 | 0.25 |
| | IV-1 | 0.01 | IV-1 | 0.01 | IV-1 | 0.01 |
| | V-1 | 0.025 | V-1 | 0.01 | V-1 | 0.02 |
| 105 (present invention) | I-1 | 0.145 | I-1 | 0.14 | I-1 | 0.14 |
| | II-1 | 0.14 | II-1 | 0.13 | II-1 | 0.14 |
| 106 (present invention) | I-1 | 0.1 | I-1 | 0.1 | I-1 | 0.1 |
| | II-1 | 0.15 | II-1 | 0.15 | II-1 | 0.15 |
| | IV-1 | 0.01 | IV-1 | 0.01 | IV-1 | 0.01 |
| | V-1 | 0.025 | V-1 | 0.01 | V-1 | 0.02 |
| 107 (present invention) | I-7 | 0.1 | I-7 | 0.1 | I-7 | 0.1 |
| | III-1 | 0.15 | III-1 | 0.15 | III-1 | 0.15 |
| | IV-1 | 0.01 | IV-1 | 0.01 | IV-1 | 0.01 |
| | V-1 | 0.025 | V-1 | 0.01 | V-1 | 0.02 |
| 108 (present invention) | I-1 | 0.275 | I-1 | 0.27 | I-1 | 0.27 |
| | IV-1 | 0.1 | IV-1 | 0.01 | IV-1 | 0.01 |
| 109 (comparative) | II-1 | 0.26 | II-1 | 0.26 | II-1 | 0.26 |
| | V-1 | 0.025 | V-1 | 0.01 | V-1 | 0.02 |
| 110 (comparative) | II-1 | 0.25 | II-1 | 0.25 | II-1 | 0.25 |
| | IV-1 | 0.01 | IV-1 | 0.01 | IV-1 | 0.01 |
| | V-1 | 0.025 | V-1 | 0.01 | V-1 | 0.02 |
| 111 (comparative) | II-1 | 0.1 | II-1 | 0.1 | II-1 | 0.1 |
| | III-1 | 0.15 | III-1 | 0.15 | III-1 | 0.15 |
| | IV-1 | 0.01 | IV-1 | 0.01 | IV-1 | 0.01 |
| | V-1 | 0.025 | V-1 | 0.01 | V-1 | 0.02 |
| 112 (comparative) | II-1 | 0.275 | II-1 | 0.27 | II-1 | 0.27 |
| | IV-1 | 0.01 | IV-1 | 0.01 | IV-1 | 0.01 |
| 113 (comparative) | II-1 | 0.26 | II-1 | 0.26 | II-1 | 0.26 |
| | II-13 | 0.025 | II-13 | 0.01 | II-13 | 0.02 |
| 114 (comparative) | II-1 | 0.25 | II-1 | 0.25 | II-1 | 0.25 |
| | II-13 | 0.025 | II-13 | 0.01 | II-13 | 0.02 |
| | IV-1 | 0.01 | IV-1 | 0.01 | IV-1 | 0.01 |
| 115 (comparative) | II-1 | 0.1 | II-1 | 0.1 | II-1 | 0.1 |
| | II-13 | 0.025 | II-13 | 0.01 | II-13 | 0.02 |
| | III-1 | 0.15 | III-1 | 0.15 | III-1 | 0.15 |
| | IV-1 | 0.01 | IV-1 | 0.01 | IV-1 | 0.01 |
| 116 (present invention) | I-1 | 0.26 | I-1 | 0.26 | I-1 | 0.26 |
| | II-13 | 0.025 | II-13 | 0.01 | II-13 | 0.02 |
| 117 (present invention) | I-1 | 0.25 | I-1 | 0.25 | I-1 | 0.25 |
| | II-13 | 0.025 | II-13 | 0.01 | II-13 | 0.02 |
| | IV-1 | 0.01 | IV-1 | 0.01 | IV-1 | 0.01 |
| 118 (present invention) | I-1 | 0.1 | I-1 | 0.1 | I-1 | 0.1 |
| | II-13 | 0.025 | II-13 | 0.01 | II-13 | 0.02 |
| | III-1 | 0.15 | III-1 | 0.15 | III-1 | 0.15 |
| | IV-1 | 0.01 | IV-1 | 0.01 | IV-1 | 0.01 |
| 119 | | Blank | | Blank | | Blank |

| Processing Step | Time | Temperature |
|---|---|---|
| 1st development | 6 min. | 38° C. |
| Rinse | 2 min. | 38° C. |
| Reversal | 2 min. | 38° C. |
| Color development | 6 min. | 38° C. |
| Adjustment | 2 min. | 38° C. |
| Bleach | 6 min. | 38° C. |
| Fixing | 4 min. | 38° C. |
| Rinse | 4 min. | 38° C. |
| Stabilization | 1 min. | 25° C. |

The formulations of the various processing solutions were as follows:

1st developer

| | |
|---|---|
| Pentasodium nitrilo-N,N,N-trimethylene- | 2.0 g |

-continued

| | |
|---|---|
| phosphonate | |
| Sodium sulfite | 30 g |
| Potassium hydroquinone monosulfonate | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1,000 ml |
| pH (adjusted with hydrochloric acid or potassium hydroxide) | 9.60 |

Reversing solution

| | |
|---|---|
| Pentasodium nitrilo-N,N,N-trimethylene- | 3.0 g |

-continued

| | |
|---|---|
| phosphonate | |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH (adjusted with hydrochloric acid or potassium hydroxide) | 6.00 |
| Color developer | |
| Pentasodium nitrilo-N,N,N-trimethylene-phosphonate | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-Ethyl-(β-methanesulfonamidoethyl)-3-methyl-4-aminoaniline sulfate | 11 g |
| 3,6-Dithiaoctan-1,8-diol | 1.0 g |
| Water to make | 1,000 ml |
| pH (adjusted with hydrochloric acid or potassium hydroxide) | 11.80 |
| Adjusting solution | |
| Disodium ethylenediaminetetraacetate dihydrate | 8.0 g |
| Sodium sulfite | 12 g |
| 1-Thioglycerin | 0.4 ml |
| Water to make | 1,000 ml |
| pH (adjusted with hydrochloric acid or sodium hydroxide) | 6.20 |
| Bleaching solution | |
| Disodium ethylenediaminetetraacetate dihydrate | 2.0 g |
| Ferric ammonium ethylenediaminetetra-acetate dihydrate | 120 g |
| Potassium bromide | 100 g |
| Ammonium nitrate | 10 g |
| Water to make | 1,000 ml |
| pH (adjusted with hydrochloric acid or sodium hydroxide) | 5.70 |
| Fixing solution | |
| Ammonium thiosulfate | 80 g |
| Sodium sulfite | 5.0 g |
| Sodium bisulfite | 5.0 g |
| Water to make | 1,000 ml |
| pH (adjusted with hydrochloric acid or aqueous ammonia) | 6.60 |
| Stabilizing solution | |
| 37% Formaldehyde | 5.0 ml |
| Polyoxyethylene-p-monononylphenyl ether (polymerization degree: 10) | 0.5 ml |
| Water to make | 1,000 ml |
| pH | not adjusted |

The results of sensitometry and color remaining tests are set forth in Table A. RL relative sensitivity is represented relative to the relative exposure which is 1.0 larger than the minimum density.

TABLE A

| Specimen No. | RL relative sensitivity | Magenta remaining density |
|---|---|---|
| 101 (comparative) | 105 | 0.073 |
| 102 (comparative) | 107 | 0.003 |
| 103 (present invention) | 131 | 0.004 |
| 104 (present invention) | 131 | 0.005 |
| 105 (present invention) | 110 | 0.018 |
| 106 (present invention) | 137 | 0.018 |
| 107 (present invention) | 131 | 0.006 |
| 108 (present invention) | 122 | 0.005 |
| 109 (comparative) | 134 | 0.080 |
| 110 (comparative) | 137 | 0.085 |
| 111 (comparative) | 132 | 0.069 |
| 112 (comparative) | 110 | 0.074 |
| 113 (comparative) | 105 | 0.073 |
| 114 (comparative) | 108 | 0.074 |
| 115 (comparative) | 111 | 0.077 |

TABLE A-continued

| Specimen No. | RL relative sensitivity | Magenta remaining density |
|---|---|---|
| 116 (present invention) | 130 | 0.005 |
| 117 (present invention) | 132 | 0.009 |
| 118 (present invention) | 135 | 0.010 |

As can be seen in Table A, the use of the compounds and emulsions of the present invention provides a light-sensitive material which is improved in both color remaining and sensitivity values.

It is thus obvious that the present invention provides a high sensitivity and inhibits color remaining at the same time.

EXAMPLE 2

Onto a subbed cellulose triacetate film support were coated the following layer compositions to prepare a multi-layer color light-sensitive material as Specimen No. 201. (Formulation of light-sensitive layer)

The coated amount of silver halide and colloidal silver is represented in g/m$^2$ as calculated in terms of silver. The coated amount of coupler, additive and gelatin is represented in g/m$^2$. The coated amount of sensitizing dye is represented in the molar amount thereof per mole of silver halide contained in the same layer.

| | |
|---|---|
| 1st layer: antihalation layer | |
| Black colloidal silver | 0.15 |
| Gelatin | 1.90 |
| ExM-1 | $5.0 \times 10^{-3}$ |
| 2nd layer: interlayer | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| 3rd layer: low sensitivity red-sensitive emulsion layer | |
| Silver bromoiodide emulsion (AgI content: 2 mole %; internal high AgI content type; diameter in terms of sphere: 0.3 μm; fluctuation coefficient in terms of sphere: 29%; mixture of regular crystal and twinning; diameter/thickness ratio: 2.5) | 0.50 |
| Gelatin | 1.50 |
| II-2 | $4.1 \times 10^{-4}$ |
| ExC-1 | 0.11 |
| ExC-3 | 0.11 |
| ExC-4 | $3.0 \times 10^{-2}$ |
| ExC-7 | $1.0 \times 10^{-2}$ |
| Solv-1 | $7.0 \times 10^{-3}$ |
| 4th layer: middle sensitivity red-sensitive emulsion layer | |
| Silver bromoiodide emulsion (AgI content: 4 mole %; internal high AgI content type; diameter in terms of sphere: 0.55 μm; fluctuation coefficient in terms of sphere: 20%; mixture of regular crystal and twinning; diameter/thickness ratio: 1.0) | 0.85 |
| Gelatin | 2.00 |
| II-2 | $4.1 \times 10^{-4}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-2}$ |
| Solv-1 | 0.10 |
| 5th layer: high sensitivity red-sensitive emulsion layer | |

-continued

| | |
|---|---|
| Silver bromoiodide emulsion (AgI content: 10 mole %; internal high AgI content type; diameter in terms of sphere: 0.7 μm; fluctuation coefficient in terms of sphere: 30%; mixture of regular crystal and twinning; diameter/thickness ratio: 2.0) | 0.70 |
| Gelatin | 1.60 |
| II-2 | $4.1 \times 10^{-4}$ |
| ExC-5 | $7.0 \times 10^{-2}$ |
| ExC-6 | $8.0 \times 10^{-2}$ |
| ExC-7 | $1.5 \times 10^{-2}$ |
| Solv-1 | 0.15 |
| Solv-2 | $8.0 \times 10^{-2}$ |
| 6th layer: interlayer | |
| Gelatin | 1.10 |
| P-2 | 0.17 |
| Cpd-1 | 0.10 |
| Cpd-4 | 0.17 |
| Solv-1 | $5.0 \times 10^{-2}$ |
| 7th layer: low sensitivity green-sensitive emulsion layer | |
| Silver bromoiodide emulsion (AgI content: 2 mole %; internal high AgI content type; diameter in terms of sphere: 0.3 μm; fluctuation coefficient in terms of sphere: 28%; mixture of regular crystal and twinning; diameter/thickness ratio: 2.5) | 0.30 |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| Solv-1 | 0.20 |
| 8th layer: middle sensitivity green-sensitive emulsion layer | |
| Silver bromoiodide emulsion (AgI content: 4 mole %; internal high AgI content type; diameter in terms of sphere: 0.55 μm; fluctuation coefficient in terms of sphere: 20%; mixture of regular crystal and twinning; diameter/thickness ratio: 4.0) | 0.70 |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| Solv-1 | 0.20 |
| 9th layer: high sensitivity green-sensitive emulsion layer | |
| Silver bromoiodide emulsion (AgI content: 10 mole %; internal high AgI content type; diameter in terms of sphere: 0.7 μm; fluctuation coefficient in terms of sphere: 30%; mixture of regular crystal and twinning; diameter/thickness ratio: 2.0) | 0.50 |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |

-continued

| | |
|---|---|
| ExM-5 | $2.6 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| 10th layer: yellow filter layer | |
| Gelatin | 0.90 |
| Yellow colloid | $5.0 \times 10^{-2}$ |
| Cpd-1 | 0.20 |
| Solv-1 | 0.15 |
| 11th layer: low sensitivity blue-sensitive emulsion layer | |
| Silver bromoiodide emulsion (AgI content: 4 mole %; internal high AgI content type; diameter in terms of sphere: 0.55 μm; fluctuation coefficient in terms of sphere: 15%; mixture of regular crystal and twinning; octahedral grain) | 0.40 |
| Gelatin | 1.00 |
| ExS-8 | $2.0 \times 10^{-4}$ |
| ExY-1 | $9.0 \times 10^{-2}$ |
| ExY-3 | 0.90 |
| Cpd-2 | $1.0 \times 10^{-2}$ |
| Solv-1 | 0.30 |
| 12th layer: high sensitivity blue-sensitive emulsion layer | |
| Silver bromoiodide emulsion (AgI content: 10 mole %; internal high AgI content type; diameter in terms of sphere: 1.3 μm; fluctuation coefficient in terms of sphere: 25%; mixture of regular crystal and twinning; diameter/thickness ratio: 4.5) | 0.50 |
| Gelatin | 0.60 |
| ExS-8 | $1.0 \times 10^{-4}$ |
| ExY-3 | 0.12 |
| Cpd-2 | $1.0 \times 10^{-3}$ |
| Solv-1 | $4.0 \times 10^{-2}$ |
| 13th layer: 1st protective layer | |
| Finely divided silver bromoiodide grains (average grain diameter: 0.07 μm; AgI content: 1 mole %) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| 14th layer: 2nd protective layer | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Further, in order to improve preservability, processability, pressure resistance, mildew resistance, bacteria resistance, antistatic properties, and coating properties, Cpd-3, Cpd-5, Cpd-6, Cpd-7, Cpd-8, P-1, W-1, W-2, and W-3 as set forth below were incorporated into these layers.

In addition to these additives, n-butyl-p-hydroxybenzoate was incorporated into these layers. Moreover, B-4, F-1, F-4, F-5, F-6, F-7, F-8, F-9, F-10, F-11, iron salt, lead salt, gold salt, platinum salt, iridium salt, and rhodium salt were incorporated into these layers.

The chemical structure or chemical name of the compounds used in the present invention will be given below.

UV-1
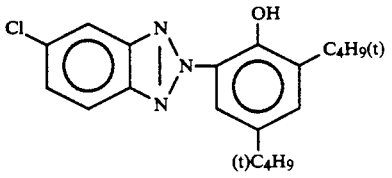
UV-2
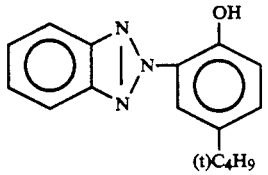
UV-3
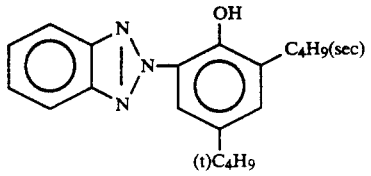
UV-4
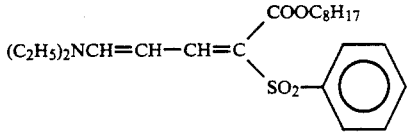
Solv-1: Tricresyl phosphate
Solv-2: Dibutyl phthalate
Solv-3: Tri(2-ethylhexyl) phosphate
ExF-1
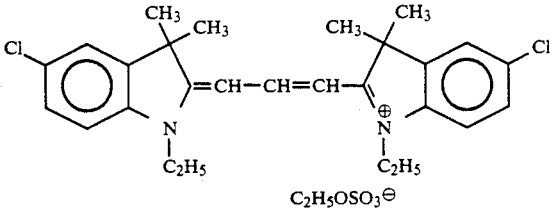
ExC-1
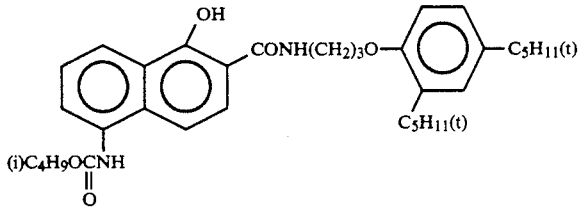
ExC-2
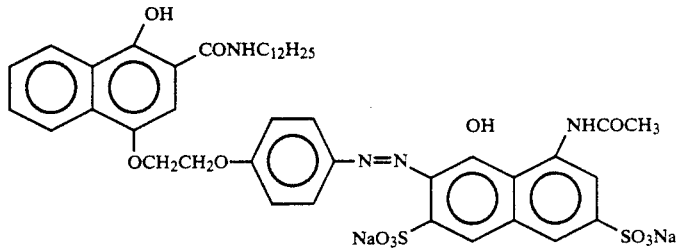

-continued
ExC-3
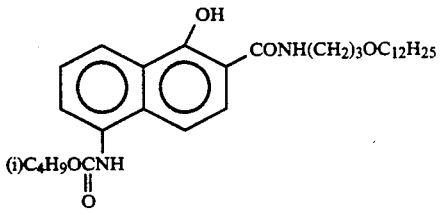
ExC-4
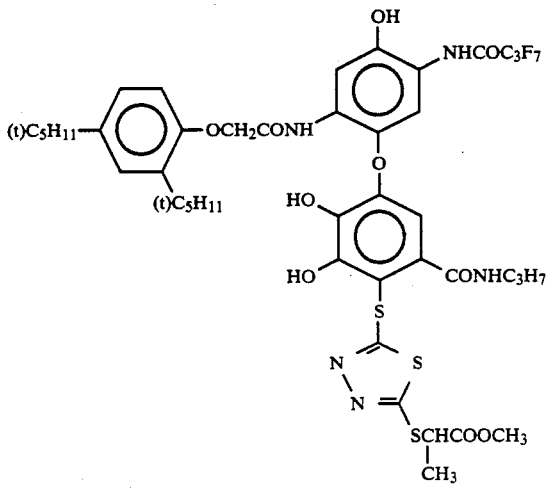
ExC-5
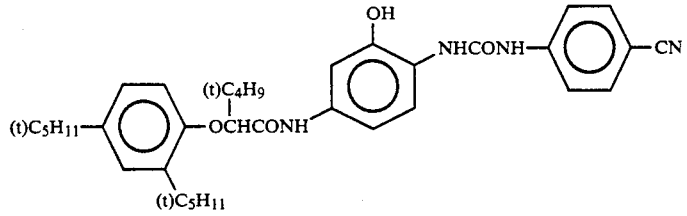
ExC-6
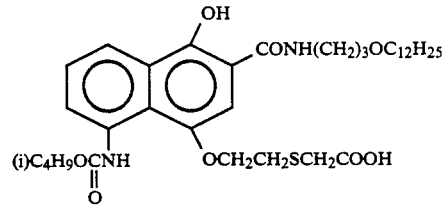
ExC-7
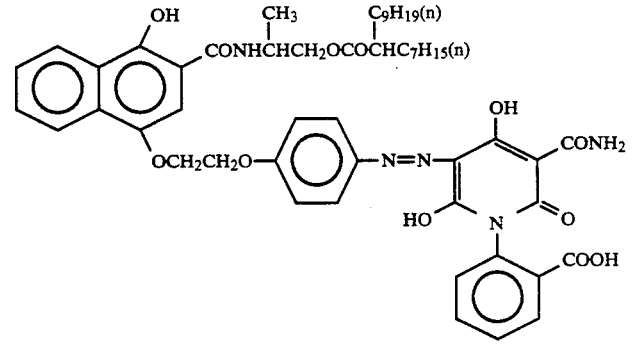

-continued
ExM-1
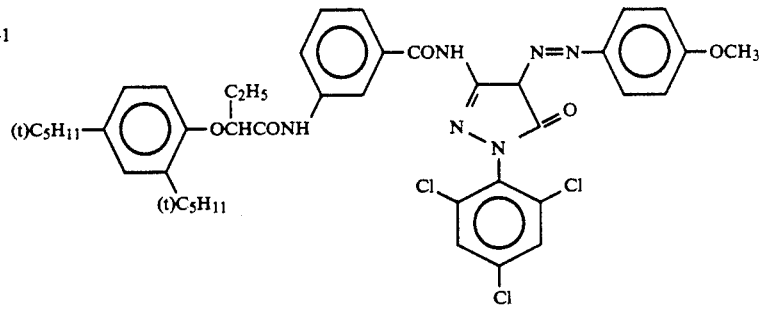
ExM-2
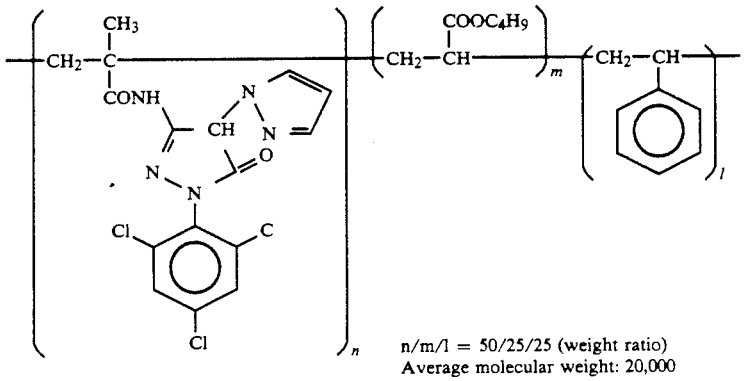
n/m/l = 50/25/25 (weight ratio)
Average molecular weight: 20,000
ExM-3
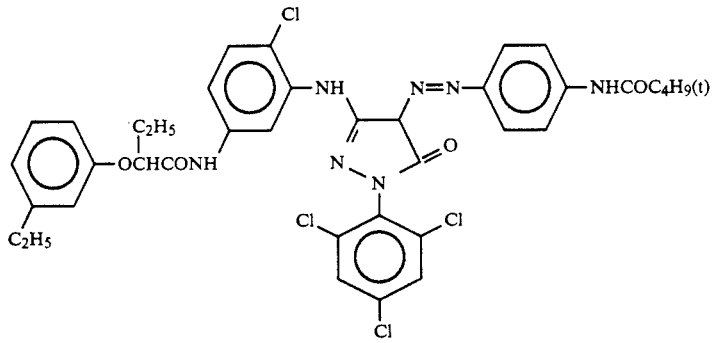
ExM-4
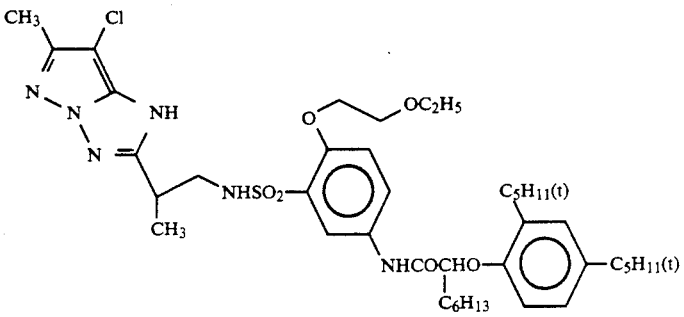

-continued
ExM-5
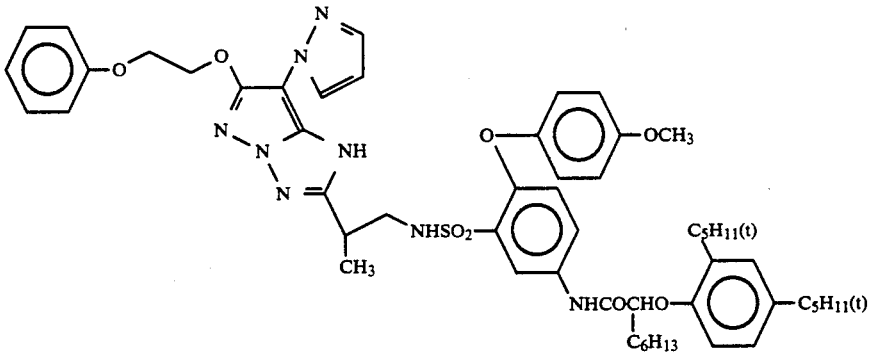
ExY-1
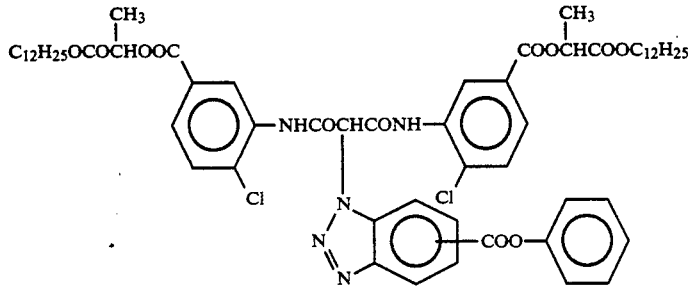
ExY-2
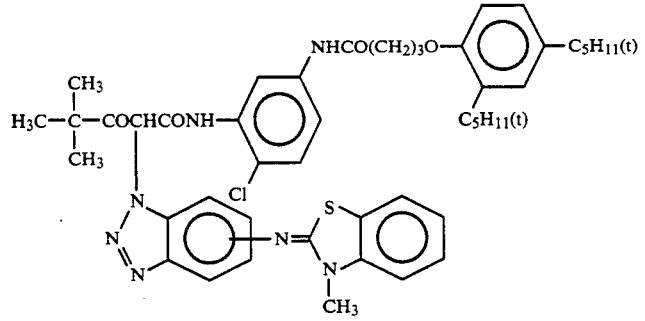
ExY-3
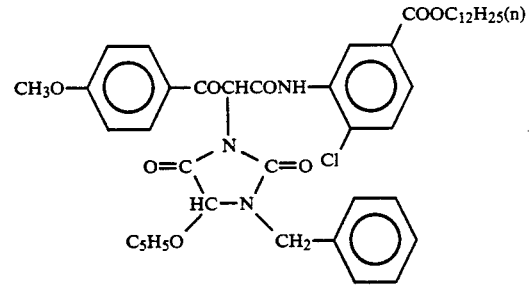
Cpd-1
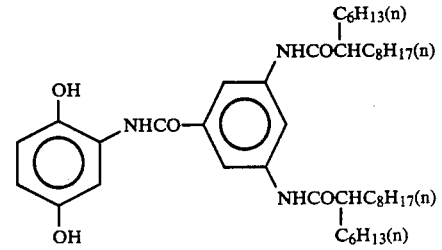

-continued
Cpd-2
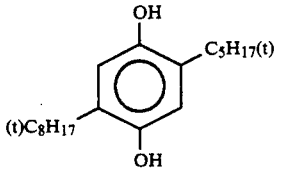
Cpd-3
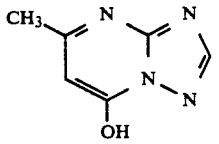
Cpd-4
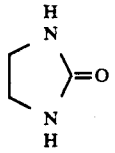
Cpd-5
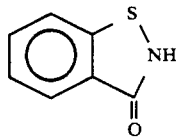
Cpd-6
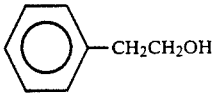
Cpd-7
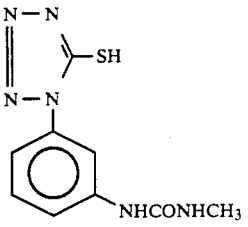
Cpd-8
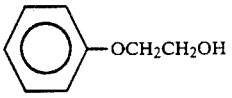
Cpd-9
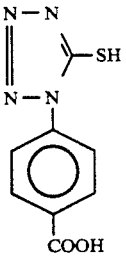
Cpd-10
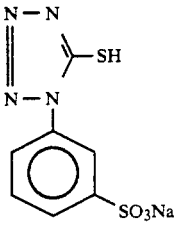

-continued
Cpd-11 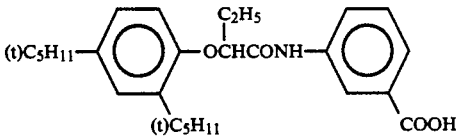
ExS-4 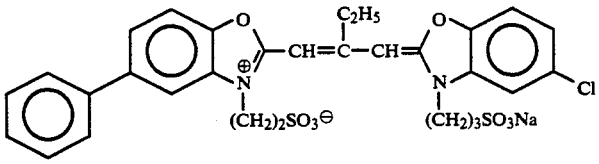
ExS-5 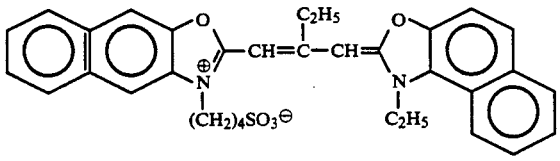
ExS-6 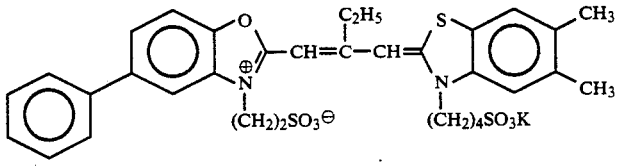
ExS-7 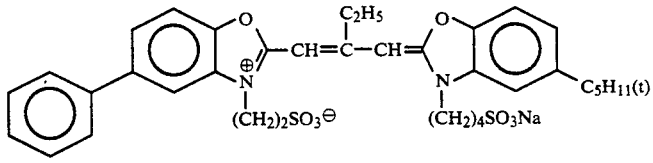
ExS-7 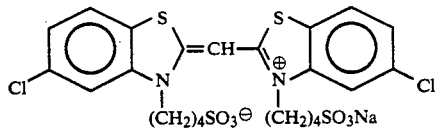
B-1 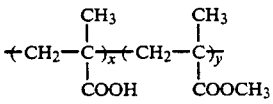 x/y = 10/90
B-2 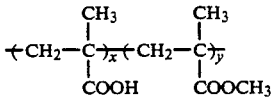 x/y = 40/60
B-3 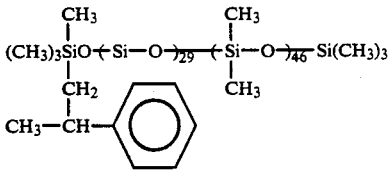
B-4 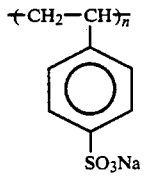

-continued
$CH_2{=}CH{-}SO_2{-}CH_2{-}CONH{-}CH_2$
$CH_2{=}CH{-}SO_2{-}CH_2{-}CONH{-}CH_2$
W-1 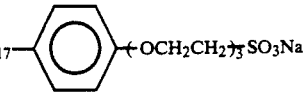
W-2 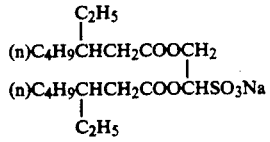
W-3 $C_8F_{17}SO_2N(C_3H_7)CH_2COOK$
P-1 70:30 (weight ratio) copolymer of vinyl pyrrolidone and vinyl alcohol
P-2 Polyethyl acrylate
F-1 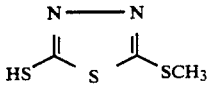
F-4 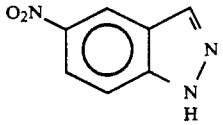
F-5 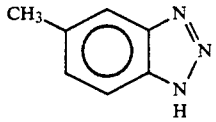
F-6 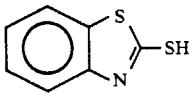
F-7 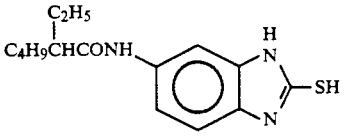
F-8 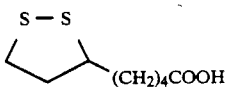
F-9 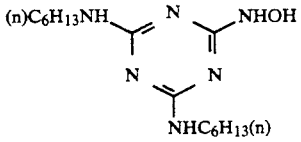
F-10 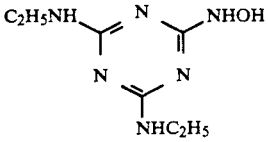
F-11 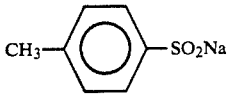

Preparation of Specimen Nos. 202–213

Specimen Nos. 202 to 212 were prepared in the same manner as Specimen No. 201 except that II-2 was replaced by the sensitizing dyes as set forth in Table B, respectively. Further, a specimen free of dyes was prepared as in Example 1 to prepare Specimen No. 213.

TABLE B

| Specimen No. | Sensitizing dye | Added amount (mole/mole Ag) |
|---|---|---|
| 201 (comparative) | II-2 | $4.1 \times 10^{-4}$ |
| 202 (comparative) | II-2 | $4.0 \times 10^{-4}$ |
| | V-1 | $1.0 \times 10^{-5}$ |
| 203 (comparative) | II-2 | $3.0 \times 10^{-4}$ |
| | IV-1 | $1.0 \times 10^{-4}$ |
| | V-1 | $1.0 \times 10^{-5}$ |
| 204 (comparative) | II-2 | $1.5 \times 10^{-4}$ |
| | III-1 | $1.5 \times 10^{-4}$ |
| | IV-1 | $1.0 \times 10^{-4}$ |
| | V-1 | $1.0 \times 10^{-5}$ |
| 205 (comparative) | I-1 | $4.1 \times 10^{-4}$ |
| 206 (present invention) | I-1 | $4.0 \times 10^{-4}$ |
| | V-1 | $1.0 \times 10^{-5}$ |
| 207 (present invention) | I-1 | $3.0 \times 10^{-4}$ |
| | IV-1 | $1.0 \times 10^{-4}$ |
| 208 (present invention) | I-7 | $4.0 \times 10^{-4}$ |
| | V-1 | $1.0 \times 10^{-5}$ |
| 209 (present invention) | I-1 | $3.0 \times 10^{-4}$ |
| | IV-1 | $1.0 \times 10^{-4}$ |
| | V-1 | $1.0 \times 10^{-5}$ |
| 210 (present invention) | I-9 | $1.5 \times 10^{-4}$ |
| | II-2 | $1.5 \times 10^{-4}$ |
| | IV-1 | $1.0 \times 10^{-4}$ |
| | V-1 | $1.0 \times 10^{-5}$ |
| 211 (present invention) | I-1 | $3.0 \times 10^{-4}$ |
| | II-13 | $1.0 \times 10^{-5}$ |
| | IV-1 | $1.0 \times 10^{-4}$ |
| 212 (present invention) | I-1 | $1.5 \times 10^{-4}$ |
| | II-1 | $1.5 \times 10^{-4}$ |
| | II-13 | $1.0 \times 10^{-4}$ |
| | IV-1 | $1.0 \times 10^{-4}$ |
| 213 | Blank | — |

Specimen Nos. 201 to 212 thus obtained were exposed to white light at an exposure of 50 CMS through a wedge for 1/100 seconds, subjected to the following processing, and then subjected to sensitometry.

For the evaluation of color remaining, the difference in the magenta stain density from the dye-free specimen (Specimen No. 213) which had been processed was determined.

The results show that the present invention provides improvements in both sensitivity and color remaining values.

(Processing method)

| Step | Processing Time | Processing temperature | Replenishment rate* | Tank capacity |
|---|---|---|---|---|
| Color development | 3 min. 15 sec. | 37.8° C. | 25 ml | 10 l |
| Bleach | 45 sec. | 38° C. | 5 ml | 4 l |
| Blix (1) | 45 sec. | 38° C. | — | 4 l |
| Blix (2) | 45 sec. | 38° C. | 30 ml | 4 l |
| Rinse (1) | 20 sec. | 38° C. | — | 2 l |
| Rinse (2) | 20 sec. | 38° C. | 30 ml | 2 l |
| Stabilization | 20 sec. | 38° C. | 20 ml | 2 l |
| Drying | 1 min. | 55° C. | | |

*per m of 35-mm wide light-sensitive material

The blix and rinse steps were effected in a counter-flow system wherein the solution flows backward from tank (2) to tank (1). The overflow from the bleach bath was all introduced into blix bath (2).

The amount of the blix solution brought over to the rinse step was 2 ml per m of a 35-mm wide light-sensitive material.

The formulation of the various processing solutions were as follows:

| | Running Solution (g) | Replenisher (g) |
|---|---|---|
| Color developer | | |
| Diethylenetriamine-pentaacetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-Ethyl-N-β-hydroxy-ethylamino]-2-methylaniline sulfate | 4.7 | 6.2 |
| Water to make | 1.0 l | 1.0 l |
| pH | 10.00 | 10.15 |
| Bleaching solution | | |
| Ferric ammonium 1,3-diamino-propanetetraacetate monohydrate | 144.0 | 206.0 |
| 1,3-Diaminopropanetetraacetic acid | 2.8 | 4.0 |
| Ammonium bromide | 84.0 | 120.0 |
| Ammonium nitrate | 17.5 | 25.0 |
| 27% Aqueous ammonia | 10.0 | 1.8 |
| 98% Acetic acid | 51.1 | 73.0 |
| Water to make | 1.0 l | 1.0 l |
| pH | 4.3 | 3.4 |
| Blix solution | | |
| Ferric ammonium ethylene-diaminetetraacetate dihydrate | 50.0 | — |
| Disodium ethylenediamine tetraacetate | 5.0 | 25.0 |
| Ammonium sulfite | 12.0 | 20.0 |
| Aqueous solution of ammonium thiosulfate (700 g/l) | 290.0 ml | 320.0 ml |
| 27% Aqueous ammonia | 6.0 ml | 15.0 ml |
| Water to make | 1.0 l | 1.0 l |
| pH | 6.8 | 8.0 |

Rinsing solution (common to both running solution and replenisher)

Tap water was passed through a mixed bed column filled with an H type strongly acidic cation exchange resin (Amberlite IR-120B produced by Rohm & Haas) and an OH type anion exchange resin (Amberlite IR-400) so that the calcium and magnesium ion concentrations were each reduced to 3 mg/l or less. To the solution were then added 20 mg/l of dichlorinated sodium isocyanurate and 150 mg/l of sodium sulfate. The pH range of the solution was from 6.5 to 7.5.

| Stabilizing solution (common to both running solution and replenisher | |
|---|---|
| 37% Formaldehyde | 1.2 ml |
| Surface active agent $[C_{10}H_{21}—0—(CH_2CH_2O)_{10}—H]$ | 0.4 g |
| Ethylene glycol | 1.0 g |
| Water to make | 1.0 l |
| pH | 5.0–7.0 |

EXAMPLE 3

Preparation of Specimen No. 301

Onto a polyethylene-double-laminated paper support were coated the following 1st to 12th layers to prepare a color photographic light-sensitive material. The 1st layer side of the polyethylene contained 15% by weight of an anatase type titanium oxide as a white pigment and a slight amount of ultramarine as a bluish dye.

(Formulation of light-sensitive material)

The components used and their coated amount in g/m$^2$ are set forth below. The coated amount of silver halide is represented as calculated in terms of silver.

| | |
|---|---|
| 1st layer: gelatin layer | |
| Gelatin | 1.30 |
| 2nd layer: antihalation layer | |
| Black colloidal silver | 0.10 |
| Gelatin | 0.70 |
| 3rd layer: low sensitivity red-sensitive layer | |
| Silver bromochloroiodide spectrally sensitized with a red-sensitizing dye (II-2) (silver chloride content: 1 mole %; silver iodide content: 4 mole %; average grain size: 0.3 μm; grain size distribution: 10%; cubic iodine core type core-shell grain) | 0.06 |
| Silver bromoiodide spectrally sensitized with a red-sensitizing dye (II-2) (silver iodide content: 4 mole %; average grain size: 0.5 μm; grain size distribution: 15%; cubic grain) | 0.10 |
| Gelatin | 1.00 |
| Cyan coupler (ExC-1) | 0.14 |
| Cyan coupler (ExC-2) | 0.07 |
| Discoloration inhibitor (Cpd-2,3,4: same amount) | 0.12 |
| Coupler dispersant (Cpd-6) | 0.03 |
| Coupler solvent (Solv-1,2,3: same amount) | 0.06 |
| Development accelerator (Cpd-13) | 0.05 |
| 4th layer: high sensitivity red-sensitive layer | |
| Silver bromoiodide spectrally sensitized with a red-sensitizing dye (II-2) (silver iodide content: 6 mole %; average grain size: 0.8 μm; grain size distribution: 20%; tabular grain (aspect ratio: 8); iodine core) | 0.15 |
| Gelatin | 1.00 |
| Cyan coupler (ExC-1) | 0.20 |
| Cyan coupler (ExC-2) | 0.10 |
| Discoloration inhibitor (Cpd-2,3,4: same amount) | 0.15 |
| Coupler dispersant (Cpd-6) | 0.03 |
| Coupler solvent (Solv-1,2,3: same amount) | 0.10 |
| 5th layer: interlayer | |
| Magenta colloidal silver | 0.02 |
| Gelatin | 1.00 |
| Discoloration inhibitor (Cpd-7,16) | 0.08 |
| Discoloration inhibitor solvent (Solv-4,5) | 0.16 |
| Polymer latex (Cpd-8) | 0.10 |
| 6th layer: low sensitivity green-sensitive layer | |
| Silver bromochloroiodide spectrally sensitized with a green-sensitizing dye (ExS-4) (silver chloride content: 1 mole %; silver iodide content: 2.5 mole %; average grain size: 0.28 μm; grain size distribution: 8%; cubic iodine core type core-shell grain) | 0.04 |
| Silver bromoiodide spectrally sensitized with a green-sensitizing dye (ExS-4) (silver iodide content: 2.5 mole %; average grain size: 0.48 μm; grain size distribution: 12%; cubic grain) | 0.06 |
| Gelatin | 0.80 |
| Magenta coupler (ExM-1,2: same amount) | 0.10 |

-continued

| | |
|---|---|
| Discoloration inhibitor (Cpd-9) | 0.10 |
| Stain inhibitor (Cpd-10,11: same amount | 0.01 |
| Stain inhibitor (Cpd-5) | 0.001 |
| Stain inhibitor (Cpd-12) | 0.01 |
| Coupler dispersant (Cpd-6) | 0.05 |
| Coupler solvent (Solv-4,6) | 0.15 |
| 7th layer: high sensitivity green-sensitive layer | |
| Silver bromoiodide spectrally sensitized with a green-sensitizing dye (ExS-4) (silver iodide content: 3.5 mole %; average grain size: 1.0 μm; grain size distribution: 21%; tabular grain (aspect ratio: 9); uniform iodine type) | 0.10 |
| Gelatin | 0.80 |
| Magenta coupler (ExM-1,2: same amount) | 0.10 |
| Discoloration inhibitor (Cpd-9) | 0.10 |
| Stain inhibitor (Cpd-10,11,22: same amount) | 0.01 |
| Stain inhibitor (Cpd-5) | 0.001 |
| Stain inhibitor (Cpd-12) | 0.01 |
| Coupler dispersant (Cpd-6) | 0.05 |
| Coupler solvent (Solv-4,6: same amount) | 0.15 |
| 8th layer: yellow filter layer | |
| Yellow colloidal silver | 0.20 |
| Gelatin | 1.00 |
| Discoloration inhibitor (Cpd-7) | 0.06 |
| Discoloration inhibitor solvent (Solv-4,5: same amount) | 0.15 |
| Polymer latex (Cpd-8) | 0.10 |
| 9th layer: low sensitivity blue-sensitive layer | |
| Silver bromochloroiodide spectrally sensitized with a blue-sensitizing dye (ExS-5,6) (silver chloride content: 2 mole %; silver iodide content: 2.5 mole %; average grain size: 0.38 μm; grain size distribution: 8%; cubic iodine core type core-shell grain) | 0.07 |
| Silver bromoiodide spectrally sensitized with a blue-sensitizing dye (ExS-5,6) (silver iodide content: 2.5 mole %; average grain size: 0.55 μm; grain size distribution: 11%; cubic grain) | 0.10 |
| Gelatin | 0.50 |
| Yellow coupler (ExY-1,2: same amount) | 0.20 |
| Stain inhibitor (Cpd-5) | 0.001 |
| Discoloration inhibitor (Cpd-14) | 0.10 |
| Coupler dispersant (Cpd-6) | 0.05 |
| Coupler solvent (Solv-2) | 0.05 |
| 10th layer: high sensitivity blue-sensitive layer | |
| Silver bromoiodide spectrally sensitized with a blue-sensitizing dye (ExS-5,6) (silver iodide content: 2.5 mole %; average grain size: 1.4 μm; grain size distribution: 21%; tabular grain (aspect ratio: 14)) | 0.25 |
| Gelatin | 1.00 |
| Yellow coupler (ExY-1,2: same amount) | 0.40 |
| Stain inhibitor (Cpd-5) | 0.002 |
| Discoloration inhibitor (Cpd-14) | 0.10 |
| Coupler dispersant (Cpd-6) | 0.15 |
| Coupler solvent (Solv-2) | 0.10 |
| 11th layer: ultraviolet absorbing layer | |
| Gelatin | 1.50 |
| Ultraviolet absorbent (Cpd-1,2,4,15: same amount) | 1.00 |
| Discoloration inhibitor (Cpd-7,16: same amount) | 0.06 |
| Dispersant (Cpd-6) | |
| Ultraviolet absorbing solvent (Solv-1,2: same amount) | 0.15 |
| Irradiation inhibiting dye (Cpd-17,18: same amount) | 0.02 |
| Irradiation inhibiting dye (Cpd-19,20: same amount) | 0.02 |
| 12th layer: protective layer | |
| Finely divided silver bromochloride grains (silver chloride content: 97 mole %; average size: 0.2 μm) | 0.07 |
| Modified POVAL | 0.02 |
| Gelatin | 1.50 |

-continued

| | |
|---|---|
| Gelatin hardener (H-1,2: same amount) | 0.17 |

To each of these layers were further added Alkanol XC (DuPont) and sodium alkylbenzenesulfonate as emulsion dispersion aids and succinic ester and Magefac F-120 (produced by Dainippon Ink & Chemicals, Inc.) as coating aids. To the silver halide or colloidal silver-containing layer were added stabilizers (Cpd-21,22,23). The chemical structure of the compounds used in the present example will be set forth below.

ExS-4

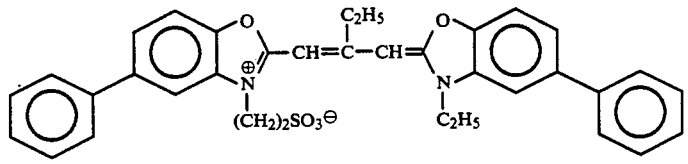

ExS-5

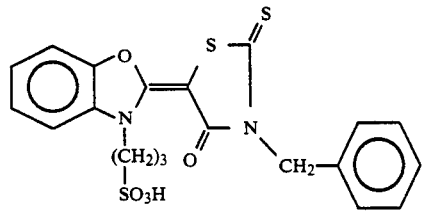

ExS-6

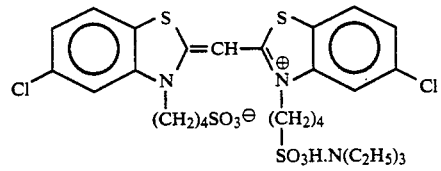

Cpd-1

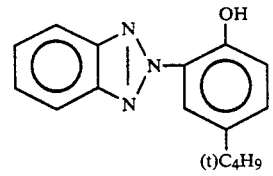

Cpd-2

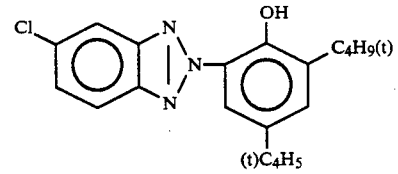

Solv-3: Di(3-methylhexyl)phthalate

Solv-4: Tricresyl phosphate

Solv-5: Dibutyl phthalate

Solv-6: Triocytl phosphate

H-1 $CH_2{=}CH{-}SO_2{-}CH_2{-}CONH{-}CH_2$
$CH_2{=}CH{-}SO_2{-}CH_2{-}CONH{-}CH_2$

H-2 Sodium salt of 4,6-dichloro-2-hydroxy-1,3,5-triazine

-continued
ExY-1
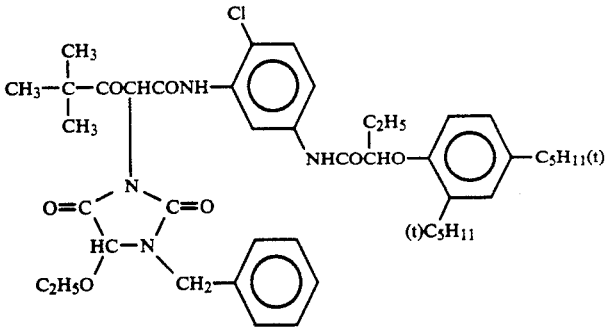
ExY-2
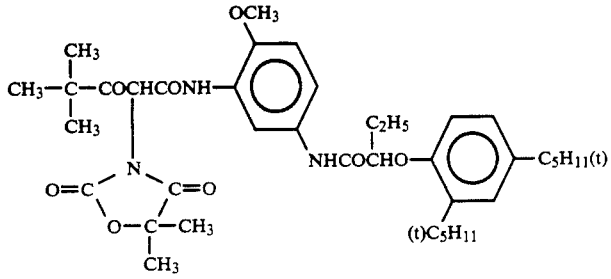
ExY-2
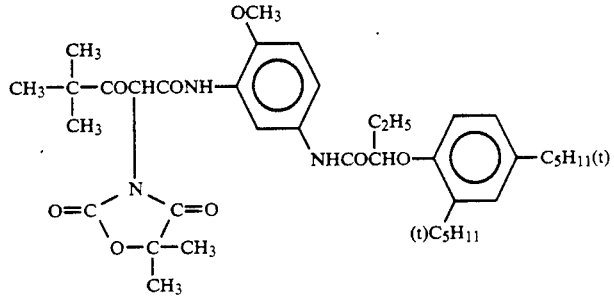
Solv-1: Di(2-ethylhexyl)phthalate
Solv-2: Trinonyl phosphate
ExC-2
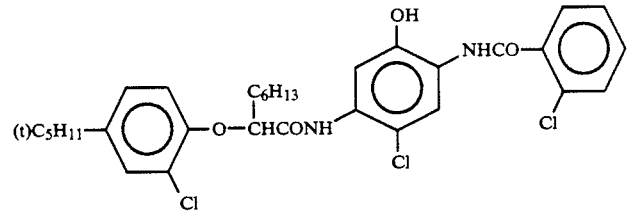
ExM-1
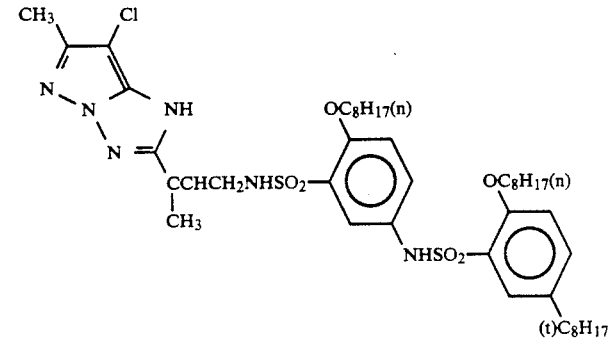

-continued
ExM-2
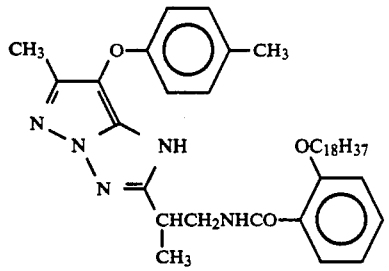
Cpd-21
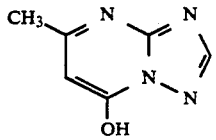
Cpd-22
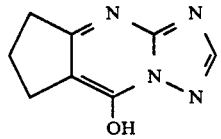
Cpd-23
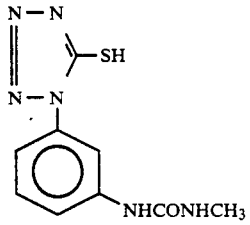
ExC-1
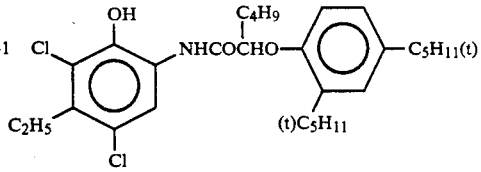
Cpd-17
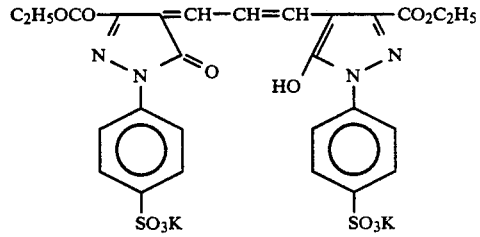
Cpd-18
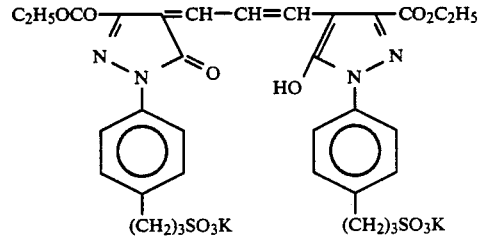

-continued
Cpd-19
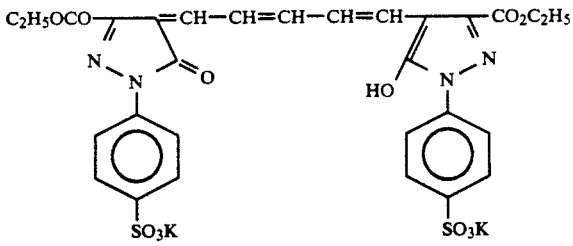
Cpd-20
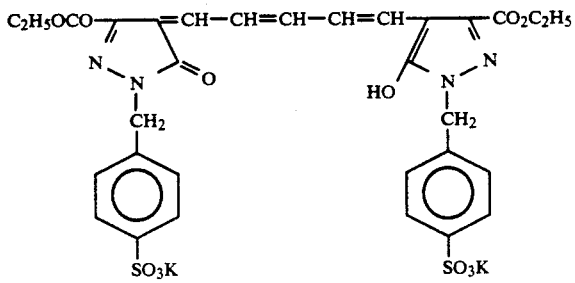
Cpd-12
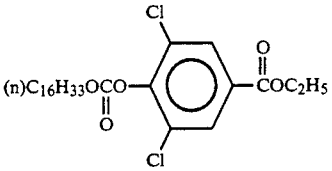
Cpd-13
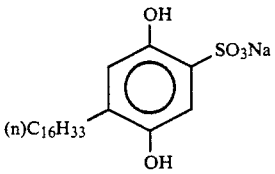
Cpd-14
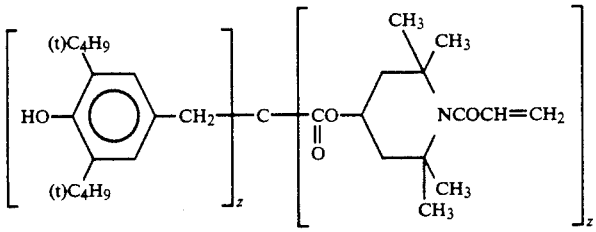
Cpd-15
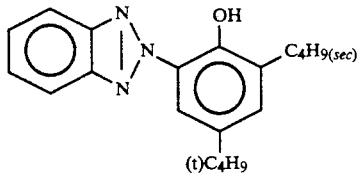
Cpd-16
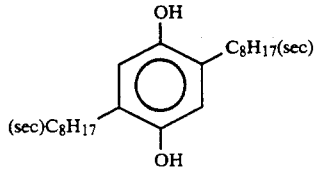
Cpd-8: Polyethyle acrylate (MW: 10,000–100,000)

-continued
Cpd-9:
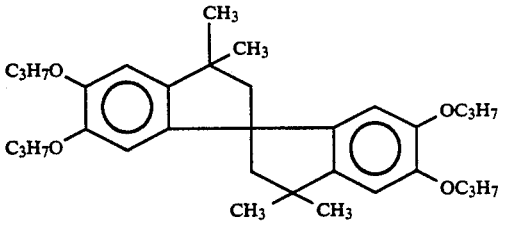
Cpd-10
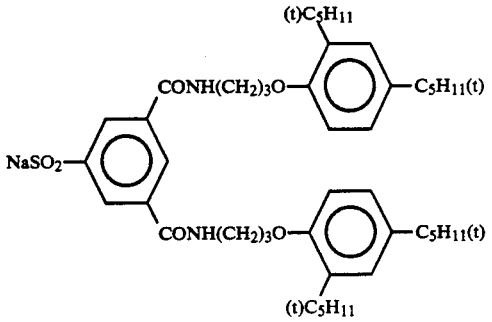
Cpd-11
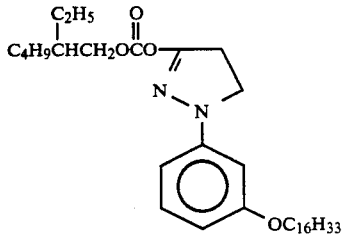
Cpd-3
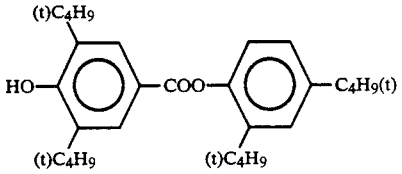
Cpd-4
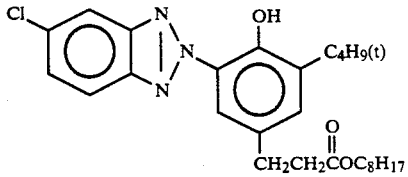
Cpd-5
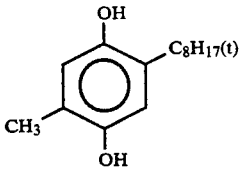
Cpd-6 $\leftarrow CH_2-\underset{\underset{CONHC_4H_9(t)}{|}}{CH}\rightarrow_n$ (n = 100~1000)
Cpd-7
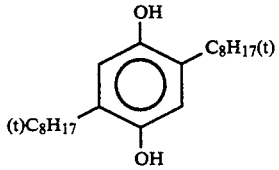
Specimen Nos. 302 to 313 were prepared in the same manner as Specimen No. 301 except that the sensitizing dye II-2 was replaced by the same sensitizing dye as used in the specimens in Example 2, respectively, as shown in Table B in that Example. These specimens were exposed to white light through a wedge, subjected to the following processing, and then evaluated in the same manner as in Examples 1 and 2.

The results show that the same effects as obtained in Examples 1 and 2 can be provided.

| Processing step | Temperature | Time |
|---|---|---|
| 1st development (black-and-white development) | 38° C. | 75 sec. |
| Rinse | 38° C. | 90 sec. |
| Reversal exposure | 100 lux or higher | 60 sec. or more |
| Color development | 38° C. | 135 sec. |
| Rinse | 38° C. | 45 sec. |
| Blix | 38° C. | 120 sec. |
| Rinse | 38° C. | 135 sec. |
| Drying | | |

The formulations of the various processing solutions were as follows:

| | |
|---|---|
| 1st developer | |
| Pentasodium nitrilo-N,N,N-trimethylene-phosphonate | 0.6 g |
| Pentasodium diethylenetriamine-pentaacetate | 4.0 g |
| Potassium sulfite | 30.0 g |
| Potassium thiocyanate | 1.2 g |
| Potassium carbonate | 35.0 g |
| Potassium hydroquinone monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 l |
| pH | 9.70 |
| Color developer | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylene-phosphonate | 0.5 g |
| Pentasodium diethylenetriamine-pentaacetate | 2.0 g |
| Sodium sulfite | 2.0 g |
| Potassium carbonate | 25.0 g |
| Hydroxylamine sulfate | 3.0 g |
| N-Ethyl-N-(β-methanesulfonamidoethyl)-3-methyl-4-aminoaniline sulfate | 5.0 g |
| Potassium bromide | 0.5 g |
| Potassium iodide | 1.0 mg |
| Water to make | 1 l |
| pH | 10.40 |
| Blix solution | |
| 2-Mercapto-1,3,4-triazole | 1.0 g |
| Disodium ethylenediaminetetraacetate dihydrate | 5.0 g |
| Ferric ammonium ethylenediamine-tetraacetate monohydrate | 80.0 g |
| Sodium sulfite | 15.0 g |
| Sodium thiosulfate (700 g/l) | 160.0 ml |
| Glacial acetic acid | 5.0 ml |
| Water to make | 1 l |
| pH | 6.50 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon (a) a layer containing at least one methine compound represented by the following general formula (I) and (b) a layer containing at least one methine compound represented by the following general formula (V):

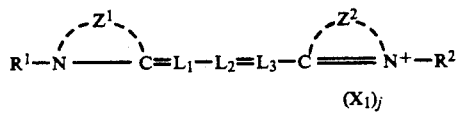

(I)

wherein $R^1$ represents $-(CH_2)_r-CONHSO_2-R^3$, $-(CH_2)_s-SO_2NHCO-R^4$, $-(CH_2)_t-CONHCO-R^5$ or $-(CH_2)_u-SO_2NHSO_2-R^6$ in which $R^3$, $R^4$, $R^5$ and $R^6$ each represents an alkyl, alkoxy or amino group, r, s, t and u each represents an integer of 1 to 5, and $R^2$ has the same meaning as $R^1$ or represents an alkyl group other than those represented by $R^1$; $Z^1$ and $Z^2$ each represents a nonmetallic atom group required to form a benzothiazole nucleus or a benzoselenazole nucleus; $L_1$, $L_2$ and $L_3$ each represents a methine group; $X_1$ represents an anion; and j represents an integer required to adjust the charge in the molecule to 0;

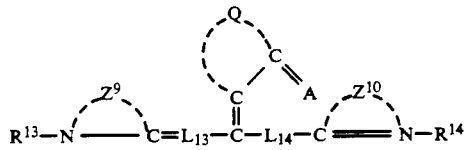

(V)

wherein $R^{13}$ and $R^{14}$ each has the same meaning as $R^2$; $Z^9$ and $Z^{10}$ each has the same meaning as $Z^1$; $L_{13}$ and $L_{14}$ each has the same meaning as $L_1$; Q represents a non-metallic atom group required to form a 5-membered or 6-membered carbon or heterocyclic group; and A represents an oxygen or sulfur atom.

2. The silver halide photographic material of claim 1, wherein the layer (a) and the layer (b) are the same layer and that same layer contains the methine compound represented by formula (V).

3. The silver halide photographic material of claim 1, wherein the photographic material further comprises silver bromoiodide or silver bromochloroiodide grains containing from about 2 mole % to about 25 mole % silver iodide, based on the total silver halide content thereof.

4. The silver halide photographic material of claim 1, wherein $R^1$ represents $-(CH_2)_r-CONHSO_2-R^3$.

5. The silver halide photographic material of claim 1, wherein $R^1$ represents $-(CH_2)_s-SO_2NHCO-R^4$.

6. The silver halide photographic material of claim 1, wherein $R^1$ represents $-(CH_2)_t-CONHCO-R^5$.

7. The silver halide photographic material of claim 1, wherein $R^1$ represents $-(CH_2)_u-SO_2NHSO_2-R^6$.

8. The silver halide photographic material of claim 1, wherein A is an oxygen atom.

9. The silver halide photographic material of claim 1, wherein A is a sulfur atom.

* * * * *